US011691833B2

(12) United States Patent
Nishii

(10) Patent No.: US 11,691,833 B2
(45) Date of Patent: Jul. 4, 2023

(54) SHEET CONVEYING DEVICE, IMAGE READING DEVICE INCORPORATING THE SHEET CONVEYING DEVICE, AND IMAGE FORMING APPARATUS INCORPORATING THE SHEET CONVEYING DEVICE

(71) Applicant: Toshikane Nishii, Kanagawa (JP)

(72) Inventor: Toshikane Nishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 17/337,862

(22) Filed: Jun. 3, 2021

(65) Prior Publication Data

US 2021/0387823 A1 Dec. 16, 2021

(30) Foreign Application Priority Data

Jun. 12, 2020 (JP) ..... 2020-102099

(51) Int. Cl.
*B65H 7/14* (2006.01)
*B65H 3/06* (2006.01)

(52) U.S. Cl.
CPC ..... *B65H 7/14* (2013.01); *B65H 3/0669* (2013.01)

(58) Field of Classification Search
CPC ..... G03G 2215/00725; G03G 2215/00628
See application file for complete search history.

(56) References Cited

U.S. PATENT DOCUMENTS

2004/0151525 A1* 8/2004 Noda ..... B41J 11/003 399/389
2008/0054554 A1 3/2008 Nishii et al.
2008/0143046 A1 6/2008 Nishii et al.
2009/0067907 A1* 3/2009 Maddux ..... G03G 15/5029 399/389
2010/0314827 A1 12/2010 Nishii et al.
2011/0158729 A1* 6/2011 Lee ..... B41J 11/003 400/578
2012/0146281 A1 6/2012 Nishii et al.
2013/0106050 A1 5/2013 Nishii et al.
2014/0091518 A1 4/2014 Nishii et al.
(Continued)

FOREIGN PATENT DOCUMENTS

JP 1-043435 2/1989
JP 5-341604 12/1993
(Continued)

*Primary Examiner* — Jennifer Bahls
(74) *Attorney, Agent, or Firm* — Harness, Dickey & Pierce, P.L.C.

(57) ABSTRACT

A sheet conveying device includes a sheet loader, a sheet feeder, an optical sensor, and a rotary member. The sheet loader is configured to load a sheet. The sheet feeder is configured to feed the sheet loaded on the sheet loader. The optical sensor is configured to detect the sheet at a predetermined position on the sheet loader in a width direction of the sheet and at a predetermined position in a sheet conveyance passage in the width direction of the sheet. The rotary member is configured to rotate to a first position when the sheet is not at the predetermined position on the sheet loader and a second position when the sheet is at the predetermined position. The rotary member has a detection target portion configured to be detected by the optical sensor when the rotary member is located at the first or second position.

19 Claims, 16 Drawing Sheets

(56) References Cited

U.S. PATENT DOCUMENTS

| | | | | |
|---|---|---|---|---|
| 2014/0355083 | A1* | 12/2014 | Omoya | B65H 7/04 271/226 |
| 2016/0016418 | A1* | 1/2016 | Kohnotoh | B65H 3/0684 347/16 |
| 2016/0167904 | A1 | 6/2016 | Nishii | |
| 2017/0277098 | A1* | 9/2017 | Yamaoka | G03G 15/6511 |
| 2018/0348687 | A1* | 12/2018 | Arai | G03G 15/6508 |
| 2021/0032054 | A1 | 2/2021 | Nishii | |

FOREIGN PATENT DOCUMENTS

| | | |
|---|---|---|
| JP | 2004-155522 | 6/2004 |
| JP | 2005-263402 | 9/2005 |
| JP | 2009-196764 | 9/2009 |
| JP | 2011-197237 | 10/2011 |
| JP | 2014-052488 | 3/2014 |
| JP | 2015-124015 | 7/2015 |

* cited by examiner

| FIG. 12A |
| --- |
| FIG. 12B |

SHEET CONVEYING DEVICE, IMAGE READING DEVICE INCORPORATING THE SHEET CONVEYING DEVICE, AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2020-102099, filed on Jun. 12, 2020, in the Japan Patent Office, the entire disclosure of which is hereby incorporated by reference herein.

BACKGROUND

Technical Field

Embodiments of the present disclosure relate to a sheet conveying device, an image reading device incorporating the sheet conveying device, and an image forming apparatus incorporating the sheet conveying device.

Background Art

Various types of sheet conveying devices are known to generally include a sheet loader on which a sheet is loaded, and a sheet feeding member to feed the sheet loaded on the sheet loader, and detect the sheet at the predetermined position in the sheet width direction on the sheet loader and the predetermined position in the sheet width direction in a sheet conveyance passage.

A known sheet conveying device includes a first detector that detects a sheet at the predetermined position in the sheet width direction in a bypass tray as a sheet loader, and a second detector that detects the sheet at the predetermined position in the sheet width direction in a sheet conveyance passage. Each of the first detector and the second detector includes an optical sensor and a rotary member. The rotary member swings (rotates) to a first position when there is no sheet at the predetermined position in the sheet width direction and a second position when there is a sheet at the predetermined position in the sheet width direction. When taking the first position or the second position, the rotary member includes a detection target portion that is detected by the optical sensor.

SUMMARY

Embodiments of the present disclosure described herein provide a novel sheet conveying device including a sheet loader, a sheet feeder, an optical sensor, and a rotary member. The sheet loader is configured to load a sheet. The sheet feeder is configured to feed the sheet loaded on the sheet loader. The optical sensor is configured to detect the sheet at a predetermined position on the sheet loader in a width direction of the sheet and at a predetermined position in a sheet conveyance passage in the width direction of the sheet. The rotary member is configured to rotate to a first position when the sheet is not at the predetermined position on the sheet loader in the width direction of the sheet and a second position when the sheet is at the predetermined position on the sheet loader. The rotary member has a detection target portion to be detected by the optical sensor when the rotary member is located at the first position or the second position.

Further, embodiments of the present disclosure described herein provide an image reading device including the above-described sheet conveying device and an image reading device. The sheet feeding device is configured to convey the sheet. The image reading device is configured to read an image on the sheet conveyed by the sheet conveying device.

Further, embodiments of the present disclosure described herein provide an image forming apparatus including the above-described sheet conveying device and an image forming device. The sheet conveying device is configured to convey the sheet. The image forming device is configured to form an image on the sheet conveyed by the sheet conveying device.

BRIEF DESCRIPTION OF THE SEVERAL VIEWS OF THE DRAWINGS

Exemplary embodiments of this disclosure will be described in detail based on the following figures, wherein.

Figure 1:
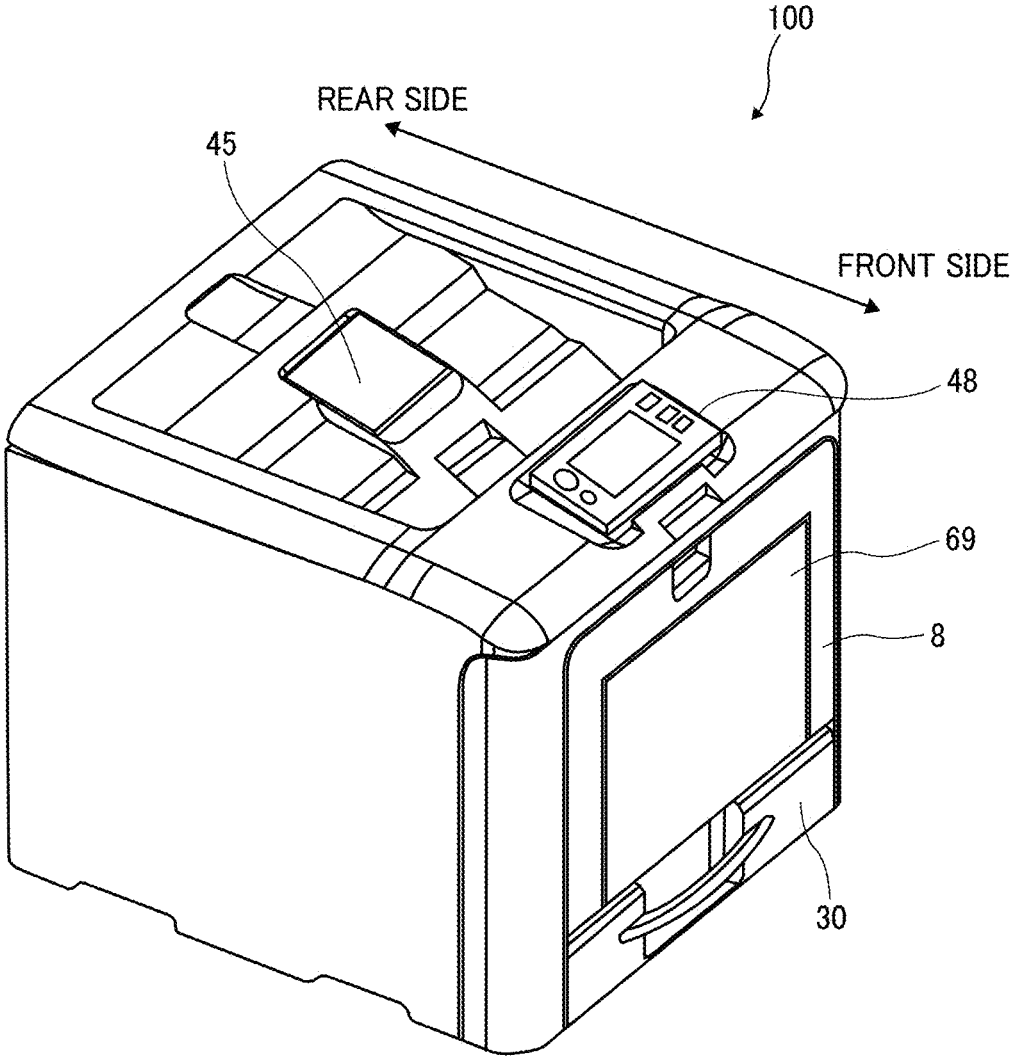
FIG. 1 is a perspective view illustrating the exterior of a tandem-type color laser printer as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to"

another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a sheet conveying device, an image reading device, and an image forming apparatus. It is to be noted that elements (for example, mechanical parts and components) having the same functions and shapes are denoted by the same reference numerals throughout the specification and redundant descriptions are omitted.

Now, a description is given of an image forming apparatus according to an embodiment of the present disclosure.

In the following description, the term "image forming apparatus" refers to an image forming apparatus that performs image formation by attaching developer or ink to a medium such as paper, OHP sheet, yarn, fiber, cloth, leather, metal, plastic, glass, wood, ceramics and the like.

Further, it is to be noted that the term "image formation" indicates an action for providing (i.e., printing) not only an image having meanings such as texts and figures on a recording medium but also an image having no meaning such as patterns on a recording medium. Further, it is to be noted that the term "sheet" is not limited to indicate a paper sheet but also includes OHP transparency sheet, cloth, and a material which is called as a recording target medium, a recording medium, a recording sheet, or a recording paper, and is used to which the developer or ink is attracted.

In the above-described embodiment, a sheet is described as the "paper sheet", and the dimensions, the materials, the shapes, the relative arrangements, and the like described for the respective component are examples, and the scope of the present invention is not intended to be limited thereto unless otherwise particularly specified. Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

FIG. 1 is a perspective view illustrating the exterior of a tandem-type color laser printer that functions as an image forming apparatus 100 according to an embodiment of the present disclosure.

A plurality of photoconductors, each functioning as an image bearer, are aligned in the image forming apparatus 100.

Figure 2:
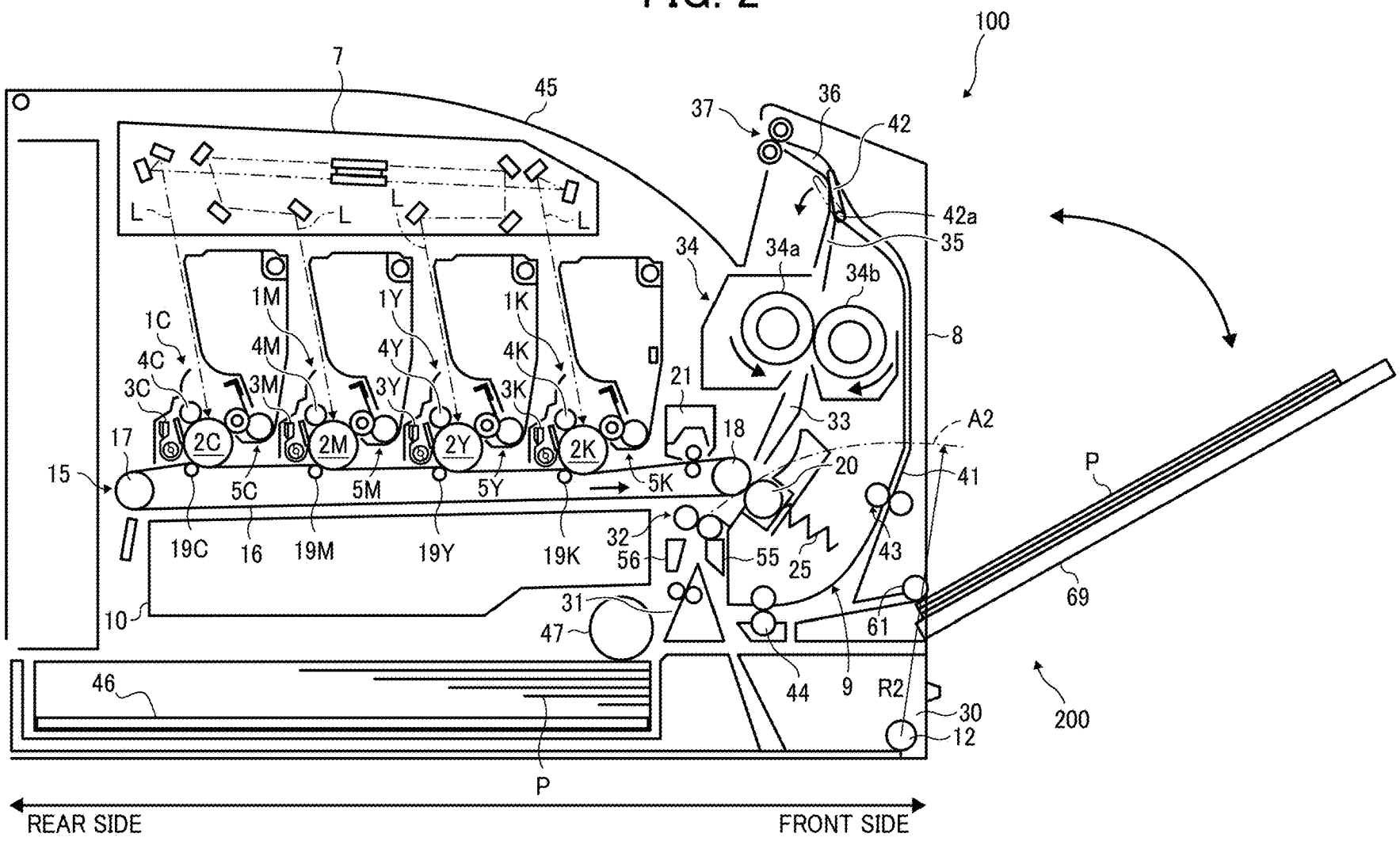
FIG. 2 is a diagram illustrating a schematic configuration of the image forming apparatus of FIG. 1.

FIG. 2 is a diagram illustrating a schematic configuration of the image forming apparatus 100 of FIG. 1.

The image forming apparatus 100 includes a sheet tray 30, a cover 8, a sheet ejection tray 45, a control panel 48, and process units 1C, 1M, 1Y, and 1K. The sheet tray 30 contains a plurality of sheets P in a layered state. The cover 8 is disposed above the sheet tray 30 on the housing of the image forming apparatus 100. The cover 8 is provided to check the inside of the image forming apparatus 100. The cover 8 opens and closed with respect to the housing of the image forming apparatus 100 and rotates about a rotary shaft 12 that rotatably supports the lower part of the cover 8. The sheet ejection tray 45 is disposed atop the housing of the image forming apparatus 100. After an image is formed on the surface of a sheet P, the sheet P is ejected from the image forming apparatus 100 to the sheet ejection tray 45.

The control panel 48 is disposed on the upper portion of the front side of the image forming apparatus 100. The control panel 48 functions as an input device through which a user inputs various information.

As illustrated in FIG. 2, the image forming apparatus 100 includes four process units 1C, 1M, 1Y, and 1K, each functioning as an image forming device (image formation device), to form respective color images of cyan (C), magenta (M), yellow (Y), and black (K), respectively.

The four process units 1C, 1M, 1Y, and 1K have identical configurations, except for toner colors. In the following description, for convenience, C (cyan), M (magenta), Y (yellow), and K (black) are added as suffixes corresponding to the toner colors of the image to be formed after reference numerals indicating respective units and members. Note that, in the general description, these suffixes are appropriately omitted, and the respective units and parts are described collectively in a singular form.

The process unit 1 (i.e., the process units 1C, 1M, 1Y, and 1K) includes a drum-shaped photoconductor 2 (i.e., drum-shaped photoconductors 2C, 2M, 2Y, and 2K). The four photoconductors 2C, 2M, 2Y, and 2K are aligned along the horizontal direction (in other words, the left and right directions) at equally spaced intervals in the image forming apparatus 100 illustrated in FIG. 2. When the image forming apparatus 100 starts the printing operation, a drive source transmits a driving force to drive the photoconductors 2C, 2M, 2Y, and 2K to rotate in the clockwise direction in FIG. 2.

Various image forming units used to form an image by electrophotography are disposed around each of the photoconductors 2C, 2M, 2Y, and 2K. The image forming units includes a developing device 5 (i.e., developing devices 5C, 5M, 5Y, and 5K).

The process unit 1 (i.e., the process units 1C, 1M, 1Y, and 1K) further includes a charging roller 4 (i.e., charging rollers 4C, 4M, 4Y, and 4K) in contact with the photoconductor 2 (i.e., the photoconductors 2C, 2M, 2Y, and 2K) to uniformly charge the surface of the photoconductor 2. The image forming apparatus 100 further includes an optical writing device 7 that is disposed above the photoconductors 2C, 2M, 2Y, and 2K.

The optical writing device 7 functions as a latent image forming device to emit laser light L corresponding to image data of the color of each photoconductor 2 onto the surface of the photoconductor 2 uniformly charged by the charging roller 4 so that an electrostatic latent image is formed on the surface of the photoconductor 2.

A long and narrow space is provided between the charging roller 4 and the photoconductor 2 in the axial direction of the rotary shaft of the photoconductor 2 so that the laser light L emitted by the optical writing device 7 passes through the long and narrow space toward the photoconductor 2.

The optical writing device 7 illustrated in FIG. 1 is a laser-scanning type optical writing device that includes, e.g., laser light sources and polygon mirrors. The optical writing device 7 includes four laser diodes (LDs), each emitting the laser light L modulated according to data of an image to be formed.

The optical writing device 7 includes a housing made of metal or resin to accommodate optical parts and control parts. The optical writing device 7 includes a transmitting duct-proof member on an emission opening of the lower face.

Note that the optical writing device 7 illustrated in FIG. 2 is a single device but is not limited to the above-described configuration. For example, the image forming apparatus 100 may include a plurality of optical writing devices 7 so that each of the plurality of optical writing devices 7 is provided in each process unit 1 separately. Alternative to the laser-scanning type optical writing device, the image forming apparatus 100 may employ an optical writing device including a known light emitting diode (LED) array and an imaging device.

The electrostatic latent image formed on the surface of the photoconductor 2 (i.e., the photoconductors 2C, 2M, 2Y, and 2K) with the laser light L is developed by a developing device 5 (i.e., developing devices 5C, 5M, 5Y, and 5K) into a visible image with toner (i.e., a toner image).

The image forming apparatus 100 further includes a transfer device 15 disposed below the photoconductors 2C, 2M, 2Y, and 2K. The transfer device 15 includes an intermediate transfer belt 16 having an endless loop. The intermediate transfer belt 16 is wound around a driven roller 17 and a drive roller 18.

As the drive roller 18 that is driven by a drive source rotates, the intermediate transfer belt 16 rotates in a direction indicated by arrow in FIG. 2, so that the surface of the photoconductor 2 contacts the outer surface of the intermediate transfer belt 16.

Four primary transfer rollers 19C, 19M, 19Y, and 19K are disposed inside the loop (inner circumference) of the intermediate transfer belt 16 and facing the photoconductors 2C, 2M, 2Y, and 2K, respectively, via the intermediate transfer belt 16.

A belt cleaning device 21 is disposed near the drive roller 18 on the outer circumference of the intermediate transfer belt 16. The belt cleaning device 21 cleans the outer surface of the intermediate transfer belt 16. The belt cleaning device 21 removes residual toner and foreign materials such as paper dust from the outer surface of the intermediate transfer belt 16.

The intermediate transfer belt 16 may have a base made of resin film or rubber and have a thickness of from 50 μm to 600 μm. The intermediate transfer belt 16 applies a bias to each primary transfer roller 19 to provide a resistance value that allows the toner image borne by each photoconductor 2 to be electrostatically transferred onto the outer circumferential surface of the intermediate transfer belt 16.

The primary transfer roller 19 includes a metal roller, e.g., a core and a conductive rubber material covering the surface of the metal roller. A bias is applied to the metal roller (i.e., the core) from a power source. The conductive rubber material is, e.g., carbon-dispersed urethane rubber. The resistance of the conductive rubber material is adjusted to a volume resistance of about $10^5$ Ωcm. Note that the primary transfer roller 19 may be a metallic roller having no rubber layer.

The image forming apparatus 100 further includes a secondary transfer roller 20 is disposed at a position facing the drive roller 18 via the intermediate transfer belt 16. The secondary transfer roller 20 includes a metal roller, e.g., a core, and a conductive rubber material covering the surface of the metal roller. A bias is applied to the metal roller (i.e., the core) from the power source. The conductive rubber material is, e.g., carbon-dispersed rubber. The resistance of the conductive rubber material is adjusted to a volume resistance of about $10^7$ Ωcm.

The secondary transfer roller 20 is in contact with the intermediate transfer belt 16 at the position facing the drive roller 18 to form a secondary transfer nip region as a secondary transfer portion. In the secondary transfer nip region, a bias is applied while a sheet P that functions as a recording medium is passing between the intermediate transfer belt 16 and the secondary transfer roller 20, so that a toner image that is borne on the outer surface of the intermediate transfer belt 16 is electrostatically transferred onto the sheet P.

A powder container 10 is disposed between the intermediate transfer belt 16 and the sheet tray 30 to contain waste toner. After the secondary transfer of the toner image from the intermediate transfer belt 16 onto the sheet P is performed, the belt cleaning device 21 removes residual toner that is failed to be transferred onto the sheet P and therefore remains on the outer surface of the intermediate transfer belt 16. The residual toner removed from the intermediate transfer belt 16 is collected and conveyed along a conveyance passage to be contained in the powder container 10.

In the image forming apparatus 100 according to the present embodiment, the vertical direction of a space between the sheet tray 30 and the secondary transfer roller 20 is set to be relatively large so that guides 55 and 56 and a pair of registration rollers 32 are disposed between the sheet tray 30 and the secondary transfer roller 20. This layout generates unused space between the intermediate transfer belt 16 and the sheet tray 30 in the housing of the image forming apparatus 100. However, by disposing the powder container 10, the unused space is utilized and a reduction in overall size of the image forming apparatus 100 is achieved.

A bottom plate 46 is disposed inside the sheet tray 30, so that a plurality of sheets P is loaded in layers on the bottom plate 46 of the sheet tray 30. In FIG. 2, the left end of the bottom plate 46 is rotatably supported by a support shaft and the right end of the bottom plate 46 is swingable (movable) in the vertical direction. Further, the bottom plate 46 is constantly biased upward by the force of a spring.

A sheet feed roller 47 is disposed on the upper part disposed downstream from the sheet tray 30 in the sheet conveyance direction. The sheet feed roller 47 contacts an uppermost sheet P placed on a bundle of sheets P loaded on the bottom plate 46, so that the uppermost sheet P is fed out toward a sheet conveyance passage 31 that is downstream in the sheet conveyance direction.

Note that, as long as the sheet feed roller 47 has a function to convey the sheet P toward the sheet conveyance passage 31, the sheet feed roller 47 is not limited to a roller. For example, a belt having an endless loop wound around two rollers may be used instead of the sheet feed roller 47.

The pair of registration rollers 32 is disposed near the downstream end of the sheet conveyance passage 31 in the sheet conveyance direction. The pair of registration rollers 32 temporarily stops the sheet P when the sheet P is conveyed along the sheet conveyance passage 31 in the sheet conveyance direction.

The pair of registration rollers 32 is disposed upstream from and near the secondary transfer nip region in the sheet conveyance direction. In order to properly meet the toner image on the outer surface of the intermediate transfer belt 16 with the position of the leading end of the sheet P, the pair of registration rollers 32 temporarily stops the sheet P to bend (technically, warp) the sheet P temporarily. Then, immediately before the toner image formed on the outer surface of the intermediate transfer belt 16 reaches the secondary transfer nip region, the pair of registration rollers 32 starts to rotate again to convey the sheet P that has been stopped, at a predetermined timing to the secondary transfer nip region.

The image forming apparatus 100 as illustrated in FIG. 1 is a full front operation type printer having a control panel on the front side. Such an image forming apparatus generally includes a duplex printing unit 9 disposed on the front side of the intermediate transfer belt 16 of the image forming apparatus to reverse the sheet P when performing a duplex printing.

Therefore, there is little space on the front side of the secondary transfer roller 20 and the pair of registration rollers 32. In order to address this inconvenience, the image forming apparatus 100 according to the present embodiment provides the nip region of the secondary transfer roller 20 and the nip region of the pair of registration rollers 32 in the oblique direction to achieve the space saving of the image forming apparatus 100.

In particular, the secondary transfer roller 20 has a large compression spring 25. By disposing the compression spring 25 in the oblique direction, the unused space of the duplex printing unit 9 is utilized, and therefore the space saving in the front-back direction of the image forming apparatus 100 is achieved.

The pair of registration rollers 32 is disposed farther than the drive roller 18 stretching the intermediate transfer belt 16 in the image forming apparatus 100. Therefore, in a case in which the roller of the pair of registration rollers 32 near the cover 8 is located at the position illustrated in FIG. 2, the roller interferes with the drive roller 18 when the cover 8 opens.

That is, the rotational trajectory A2 of the cover 8 along the radius R2 from the rotary shaft 12 to the roller interferes with the drive roller 18. In order to avoid this interference, a retraction mechanism causes the roller of the pair of registration rollers 32 to swing (rotate) radially inward of the rotational trajectory A2 in the middle of opening of the cover 8.

Further, a post transfer sheet conveyance passage 33 is disposed above the secondary transfer nip region, and a fixing device 34 is disposed near the downstream end of the post transfer sheet conveyance passage 33 in the sheet conveyance direction.

The fixing device 34 includes a fixing roller 34*a* and a pressure roller 34*b*. The fixing roller 34*a* includes a heat generating source such as a halogen lamp. The pressure roller 34*b* rotates while contacting the fixing roller 34*a* with a predetermined pressure. Note that the image forming apparatus 100 is not limited to employ the fixing device 34 described above. For example, the image forming apparatus 100 may employ a fixing device having an endless rotary belt or another configuration such as an induction heating (IH) system.

A post-fixing sheet conveyance passage 35 is disposed above the fixing device 34. The post-fixing sheet conveyance passage 35 branches off to a sheet ejection passage 36 and a sheet reverse passage 41 at a branch point in the middle of the post-fixing sheet conveyance passage 35. A switching member 42 having a swing shaft 42*a* is disposed at the branch point to swing (rotate) about the swing shaft 42*a*.

Further, a pair of sheet ejection rollers 37 is disposed at the downstream end of the sheet ejection passage 36 in the sheet conveyance direction. The pair of sheet ejection rollers 37 functions as a sheet ejection member to eject the sheet P from the inside of the image forming apparatus 100.

The switching member 42 is disposed at the position indicated with a solid line in FIG. 2. By so doing, after the fixing device 34 has fixed the image to the sheet P, the sheet P is guided from the post-fixing sheet conveyance passage 35 to the sheet ejection passage 36 and ejected by the pair of sheet ejection rollers 37 to be stacked on a sheet ejection tray 45.

Further, when performing a duplex printing to form respective images on the front and back faces of the sheet P, after the trailing end of the sheet P having an image on the front face has passed the switching member 42, the switching member 42 is rotated in the counterclockwise direction, from the position indicated with the solid line in FIG. 2 to the position indicated with a broken line in FIG. 2. Then, as the pair of sheet ejection rollers 37 rotates in the reverse direction, the sheet P is guided by the switching member 42 to the sheet reverse passage 41 and conveyed by pairs of sheet conveying rollers 43 and 44 to the pair of registration rollers 32.

Next, a description is given of the basic operations of the image forming apparatus 100.

First, the operations of a single-side printing to form an image on a single face alone of the sheet P is described.

The image forming apparatus 100 includes a controller 300, the details of which is described below. As the sheet feed roller 47 of the sheet tray 30 rotates in response to a sheet conveyance signal issued by the controller 300 of the image forming apparatus 100, the uppermost sheet P on top of the bundle of sheets P loaded on the bottom plate 46 of the sheet tray 30 is separated from the other sheets in the bundle of sheets P, so that the uppermost sheet P alone is fed and conveyed to the sheet conveyance passage 31.

When the leading end of the sheet P reaches the nip region of the pair of registration rollers 32, the sheet P stands by in a state in which the sheet P is bent (warped) in order to be timed (synchronized) with movement of the toner image formed on the intermediate transfer belt 16 and to correct skew at the leading end of the sheet P.

Next, a description is given of the image forming operation performed by the image forming apparatus 100, with the process unit 1.

In this case, the image forming operation with the process unit 1K is described. First, the charging roller 4K uniformly charges the surface of the photoconductor 2K to a high electric potential (negative charging). Then, the optical writing device 7 emits the laser light L based on the image data toward the surface of the photoconductor 2K. The laser light L lowers the electric potential of the laser emitted portion of the surface of the photoconductor 2K, an electrostatic latent image is formed on the surface of the photoconductor 2K.

Black toner is borne on the outer surface of the developing roller of the developing device 5K. The black toner is electrostatically attracted to the electrostatic latent image on the surface of the photoconductor 2K, so that the electrostatic latent image on the surface of the photoconductor 2K is developed into a visible black toner image. The primary transfer roller 19K that is positively charged causes this visible black toner image to be transferred onto the outer surface of the intermediate transfer belt 16 that rotates in synchrony with rotation of the photoconductor 2K.

Such operations of latent image formation, development, and primary transfer are sequentially performed at respective timings corresponding to image data in each process unit 1 (i.e., the process units 1C, 1M, 1Y, and 1K).

As a result, a four-color toner image on which the black, yellow, magenta, and cyan toner images are sequentially overlaid is borne on the outer surface of the intermediate transfer belt 16. Accordingly, the four-color toner image is conveyed together with the intermediate transfer belt 16 in the rotational direction of the intermediate transfer belt 16 indicated by arrow in FIG. 2.

The drum cleaning unit 3K removes residual toner remaining on the surface of the photoconductor 2 after the toner image is transferred from the photoconductor 2K to the intermediate transfer belt 16. The residual toner removed from the photoconductor 2K by the drum cleaning unit 3K is conveyed by a waste toner conveyance unit and conveyed and collected to a waste toner collection unit in the process unit 1K. Further, an electric discharging unit removes residual electric charge remaining on the surface of the photoconductor 2 after removal of the residual toner by the drum cleaning unit 3K.

As described above, after the respective color toner images have been sequentially transferred in layers onto the outer surface of the intermediate transfer belt 16 to form the four-color toner image, the pair of registration rollers 32 and the sheet feed roller 47 start rotating, so that the sheet P is conveyed to the secondary transfer nip region at the same timing as (in synchrony with) movement of the four-color toner image transferred and overlaid onto the outer surface of the intermediate transfer belt 16.

The secondary transfer roller 20 is positively charged, and the toner image formed on the outer surface of the intermediate transfer belt 16 is electrostatically transferred onto the sheet P that is conveyed to the secondary transfer nip region.

The transfer residual toner and foreign materials remaining on the outer surface of the intermediate transfer belt 16 are removed from the outer surface of the intermediate transfer belt 16 by the belt cleaning device 21, so as to make the intermediate transfer belt 16 ready for subsequent image forming operation and transfer operation. After being removed from the intermediate transfer belt 16, the residual toner and foreign materials are conveyed by the waste toner conveyance unit in the sheet conveyance passage and collected to the powder container 10 to be contained in the powder container 10.

The sheet P on which the toner image is formed in the secondary transfer nip region passes through the post transfer sheet conveyance passage 33 to the fixing device 34. Thereafter, the sheet P that is conveyed to the fixing device 34 is held between the fixing roller 34*a* and the pressure roller 34*b*. Thus, the unfixed toner image on the sheet P is fixed to the sheet P by application of heat and pressure. The sheet P with the fixed toner image is conveyed from the fixing device 34 to the post-fixing sheet conveyance passage 35.

At the timing at which the sheet P is ejected from the fixing device 34, the switching member 42 is located at the position indicated with the solid line in FIG. 2, which allows the sheet P to pass around an open space at the downstream end of the post-fixing sheet conveyance passage 35 in the sheet conveyance direction. After passing through the post-fixing sheet conveyance passage 35, the sheet P is nipped by the pair of sheet ejection rollers 37 to be ejected to the sheet ejection tray 45 with the image forming face of the sheet P facing down (face-down ejection).

Next, a description is given of a series of operations when the image forming apparatus performs the duplex printing to form respective images on the front and back faces of the sheet P.

Note that the description of the process from the operation in which an image is fixed to the front face of the sheet P to the operation in which the sheet P is fed from the fixing device 34 to the post-fixing sheet conveyance passage 35 is omitted since the process in the duplex printing is same as the process in the above-described single-side printing.

When performing the duplex printing, a toner image is fixed to the front face of the sheet P and the sheet P is conveyed by the pair of sheet ejection rollers 37. After the trailing end of the sheet P passes through the post-fixing sheet conveyance passage 35, the switching member 42 swings (rotates) to the position indicated with the broken line in FIG. 2, which closes the downstream end of the post-fixing sheet conveyance passage 35 in the sheet conveyance direction. Substantially simultaneously, the pair of sheet ejection rollers 37 rotates in the reverse direction to feed back the sheet P guided by the switching member 42, to the sheet reverse passage 41.

The sheet P conveyed through the sheet reverse passage 41 passes the pairs of sheet conveying rollers 43 and 44 and reaches the pair of registration rollers 32. Then, the sheet P is fed at the timing in synchronization with movement of the toner image formed on the outer surface of the intermediate transfer belt 16 to be transferred onto the back face of the sheet P.

The image to be formed on the back face of the sheet P is sequentially formed according to the image forming operation that starts when the sheet P is conveyed to the predetermined position. The series of image forming operations in this case is also the same as the series of image forming operations in the single-side printing to form the full-color toner image as described above. Thus, the full-color toner image is borne on the intermediate transfer belt 16.

However, since the sheet P is reversed upside down in the sheet conveyance direction in the sheet reverse passage 41, the laser light L is emitted from the optical writing device 7 to the surface of the photoconductor 2 to control and execute formation of an electrostatic latent image so that the toner image is formed from the opposite side in the sheet conveyance direction, with respect to the sheet P in the previous image forming operation.

When passing through the secondary transfer nip region, the toner image on the intermediate transfer belt 16 is transferred onto the back face of the sheet P fed out from the pair of registration rollers 32. In the fixing device 34, the sheet P is held between the fixing roller 34*a* and the pressure roller 34*b* to fix the unfixed toner image formed on the back face of the sheet P to the sheet P by application of heat and pressure. The sheet P with the fixed toner image on the back face of the sheet P is conveyed through the post-fixing sheet conveyance passage 35, the sheet ejection passage 36, and the pair of sheet ejection rollers 37 to be ejected to the sheet ejection tray 45.

Note that some sheets P may be conveyed through the sheet conveyance passage 31 simultaneously in order to increase the efficiency of the duplex printing.

Further, as illustrated in FIG. 2, a bypass sheet feed tray 69 is provided on the right-side face of the housing of the image forming apparatus 100. The bypass sheet feed tray 69 is openably closable in the direction indicated by arrow in FIG. 2. By opening the bypass sheet feed tray 69, the sheet P is fed manually via the bypass sheet feed tray 69.

Figure 3:
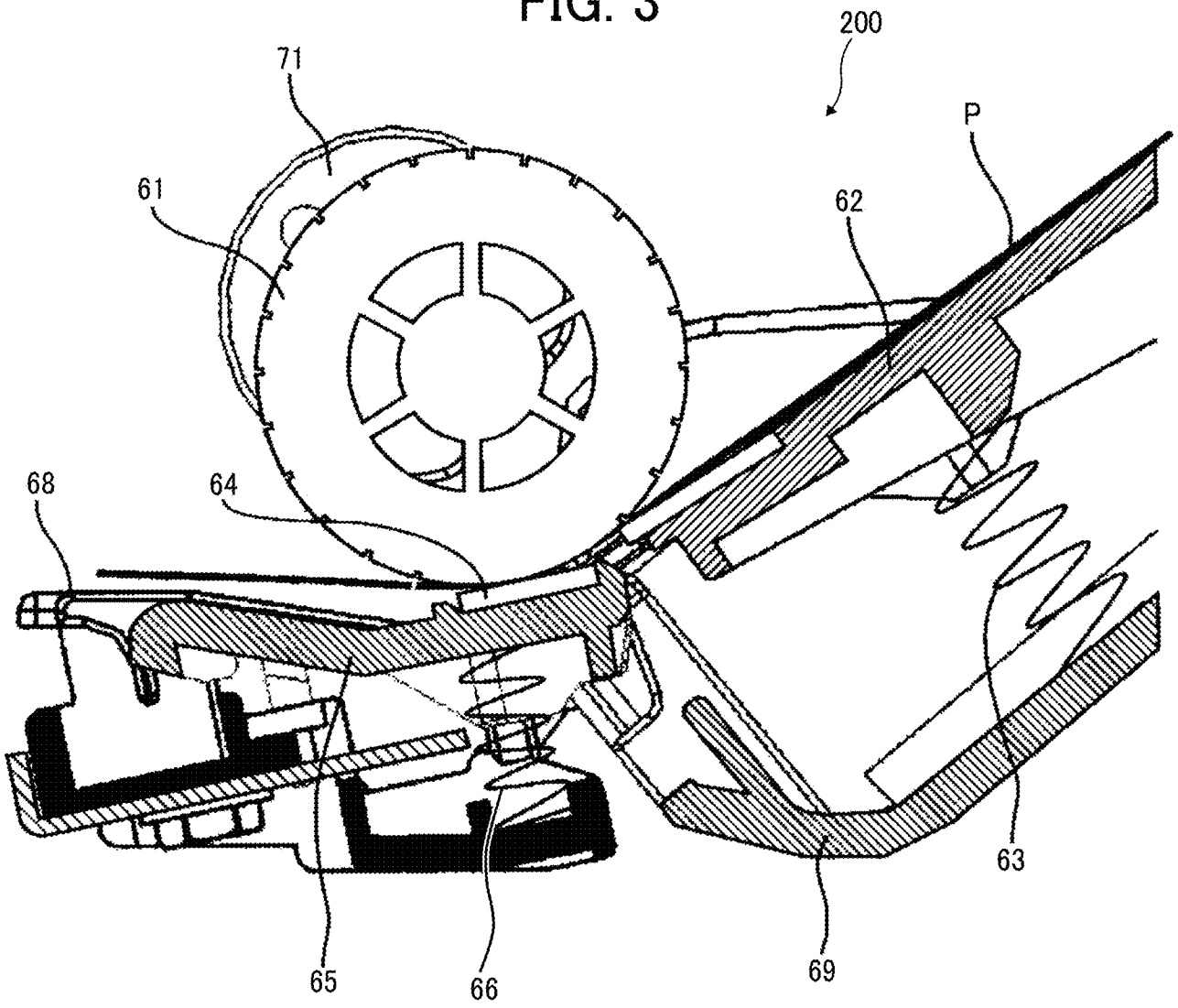
FIG. 3 is a cross-sectional view illustrating a bypass sheet feeding device.

FIG. 3 is a cross-sectional view illustrating a bypass sheet feeding device 200 that feeds sheets from the bypass sheet feed tray 69.

The bypass sheet feeding device includes a sheet feed roller 61 that functions as a sheet feeding member to feed the sheet P loaded on the bypass sheet feed tray 69 that functions as a sheet loader.

Further, the bypass sheet feed tray 69 includes a bottom plate 62 that is rotatable about the rotary shaft provided on the upstream side of the bypass sheet feed tray 69 in the sheet feeding direction. The bottom plate 62 rotates between a pressing position at which the sheet P loaded on the bypass sheet feed tray 69 is pressed against the sheet feed roller 61 and a retracted position at which the sheet P on the bypass sheet feed tray 69 is retracted (separated) from the pressing position.

A spring 63 is provided between the bypass sheet feed tray 69 and the bottom plate 62. The spring 63 functions as a biasing member that biases the bottom plate 62 toward the sheet feed roller 61. That is, the bottom plate 62 is biased by the spring 63 toward the sheet feed roller 61.

A holding member 65 is positioned to a sheet conveyance guide member 68 that guides conveyance of the sheet P. A friction member 64 is disposed on the upper face at the upstream end of the holding member 65 in the sheet feeding direction. The friction member 64 contacts the lower face of the sheet feed roller 61 at the position downstream from the bottom plate 62 in the sheet feeding direction to frictionally separate the fed sheets P one by one.

The upstream end of the holding member 65 in the sheet feeding direction is biased by the pressing force of the spring 66 toward the sheet feed roller 61, to press the friction member 64 provided on the holding member 65 and the sheet feed roller 61 to contact each other. According to this configuration, when the sheet P is fed from the bottom plate 62 to the pressed portion between the sheet feed roller 61 and the friction member 64, a constant frictional force is applied to the sheet P.

Further, even in a case in which two sheets P are conveyed to the pressed portion between the sheet feed roller 61 and the friction member 64 while the two sheets P are overlapped one another, the above-described frictional force is applied to separate the sheet P from the other sheets on the bypass sheet feed tray 69 and convey the sheet P to the inside of the image forming apparatus 100. Further, the sheet P separated from the other sheets P on the bypass sheet feed tray 69 is conveyed while being guided by the sheet conveyance guide member 68.

Further, the bypass sheet feed tray 69 is held to the cover 8 to be rotatable about the rotary shaft. Then, when the bypass sheet feeding is conducted, the bypass sheet feed tray 69 is open relative to the cover 8, which is referred to as an open state. On the other hand, when the bypass sheet feeding is not conducted, the bypass sheet feed tray 69 is closable to the cover 8, which is referred to as a closed state. Note that, when the bypass sheet feed tray 69 is closed to the cover 8, the bottom plate 62 that is rotatably supported by the bypass sheet feed tray 69 is also closed to the cover 8.

Figure 4:
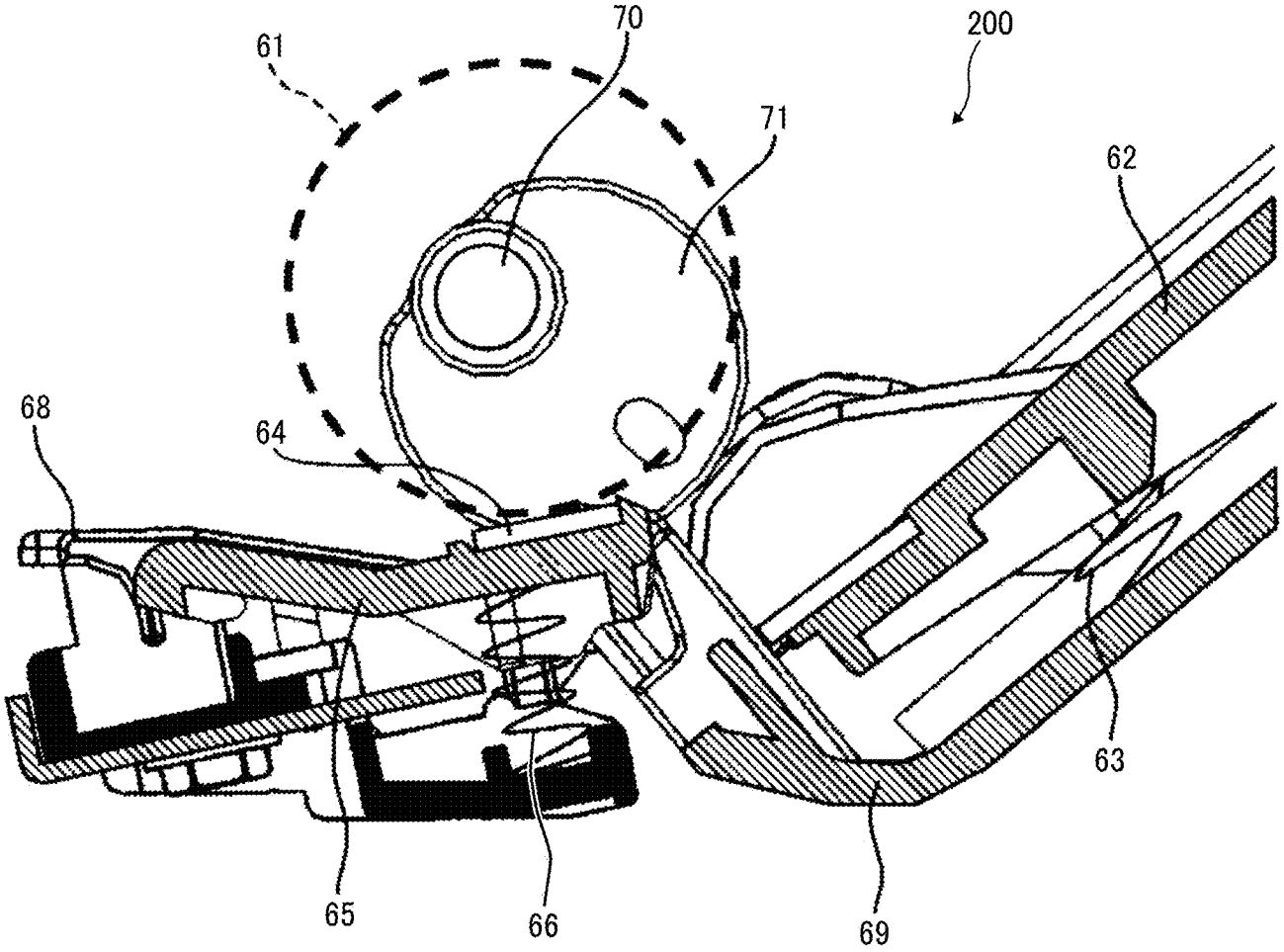
FIG. 4 is a cross-sectional view illustrating the bypass sheet feeding device of FIG. 3, after completion of a bypass sheet feeding operation.

FIG. 4 is a cross-sectional view illustrating the bypass sheet feeding device after completion of a bypass sheet feeding operation.

While the sheet feeding operation from the bottom plate 62 by the sheet feed roller 61 is performed, the sheet conveyance force needs to be applied to the sheet P by the sheet feed roller 61. To apply the sheet conveyance force to the sheet P, as illustrated in FIG. 3, the bottom plate 62 is located to the pressing position, so that the sheet P on the bottom plate 62 is pressed against the sheet feed roller 61. On the other hand, after completion of the sheet feeding operation, in consideration of a case in which a user supplies the sheet P onto the bypass sheet feed tray 69, the bottom plate 62 is retracted to the retracted position from the pressing position, as illustrated in FIG. 4, and the press contact state of the sheet P on the bottom plate 62 and the sheet feed roller 61 is released.

Note that, since the bottom plate 62 is constantly biased by the spring 63 toward the sheet feed roller 61 to apply the pressing force, as described above, a cam 71 that is rotatably supported by the sheet feed roller shaft 70 functioning as a rotary shaft of the sheet feed roller 61 is rotated to cause the cam 71 to contact the bottom plate 62. Accordingly, the bottom plate 62 is pressed upward by the cam 71 against the biasing force of the spring 63, so that the bottom plate 62 is retracted from the sheet feed roller 61.

Further, while the sheet feeding operation is performed as illustrated in FIG. 3, in order to prevent the bottom plate 62 from retracting from the pressing position so that the sheet conveyance force applied by the sheet feed roller 61 to the sheet P, the cam 71 is stopped at the position at which the cam 71 and the bottom plate 62 do not contact each other.

That is, the cam 71 is configured to stop at two positions, that is, a rising position at which the cam 71 positions the bottom plate 62 at the pressing position without contacting the bottom plate 62 and a lowering position at which the bottom plate 62 is retracted from the pressing position so as to supply the sheet P or the sheets P on the bottom plate 62.

Note that, in the depth direction of the surface of the drawing sheet of FIG. 4, the cam 71 is brought into contact with the bottom plate 62 on the outer side of the maximum sheet width that can be handled by the bypass sheet feeding device 200 that functions as a sheet conveying device, and the sheet P loaded on the bottom plate 62 and the cam 71 do not come into contact with each other.

Figure 5:
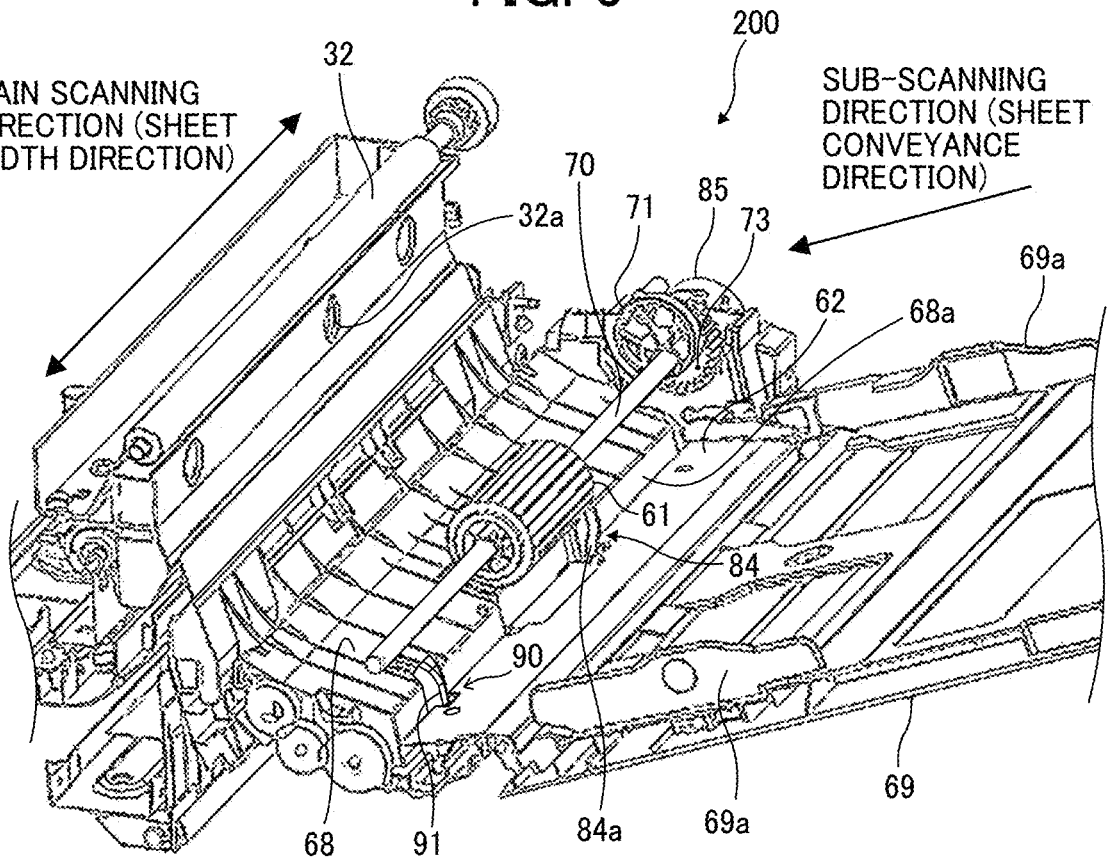
FIG. 5 is a perspective view illustrating the bypass sheet feeding device of FIG. 3.

FIG. 5 is a perspective view illustrating the bypass sheet feeding device of FIG. 3.

Figure 6:
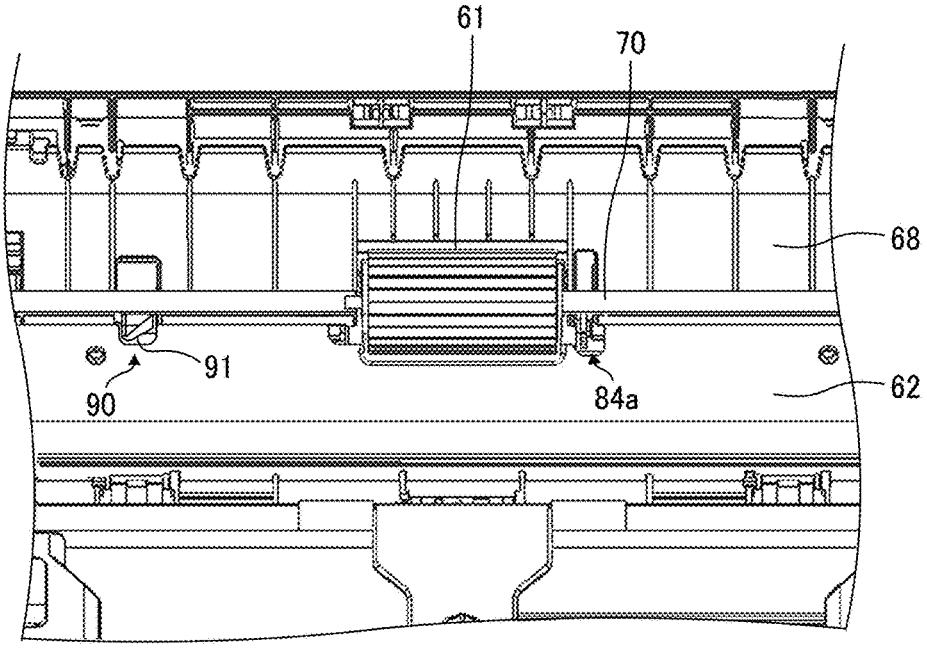
FIG. 6 is a plan view illustrating the bypass sheet feeding device of FIG. 3.

FIG. 6 is a plan view illustrating the bypass sheet feeding device of FIG. 3.

The bypass sheet feed tray 69 is provided with a pair of side fences 69*a* across the sheet P set on the bypass sheet feed tray 69 to regulate the sheet P in the width direction of the sheet P. The pair of side fences 69*a* is manually movable to be positioned according to the size in the width direction of a sheet.

The sheet feed roller 61 is prevented from rotating with respect to the sheet feed roller shaft 70 by a D-shaped cutout or a pin. A driving force is applied from a drive motor 85 that functions as a drive source via an electromagnetic clutch that switches the driving state to the sheet feed roller shaft 70 between transmission of the driving force and blocking of the driving force.

The cam 71 is mounted on the sheet feed roller shaft 70 without detention and is rotatable separately from rotation of the sheet feed roller 61, in other words, without synchronizing with rotation of the sheet feed roller 61. A gear 73 is coupled to or integrally molded with the cam 71. A driving force from the drive motor 85 is transmitted to the gear 73 via an electromagnetic clutch to rotate the cam 71.

A registration sensor 32*a* is provided in front of the pair of registration rollers 32. In response to detection of the leading end of the sheet P by the registration sensor 32*a*, the sheet conveying roller upstream from the pair of registration rollers 32 is rotated for a specified time. After a predetermined amount of bending (warping) is formed in the sheet P to deskew the position of the sheet P, the sheet conveying roller upstream from the pair of registration rollers 32 is stopped to complete the sheet feeding operation.

Figure 7:
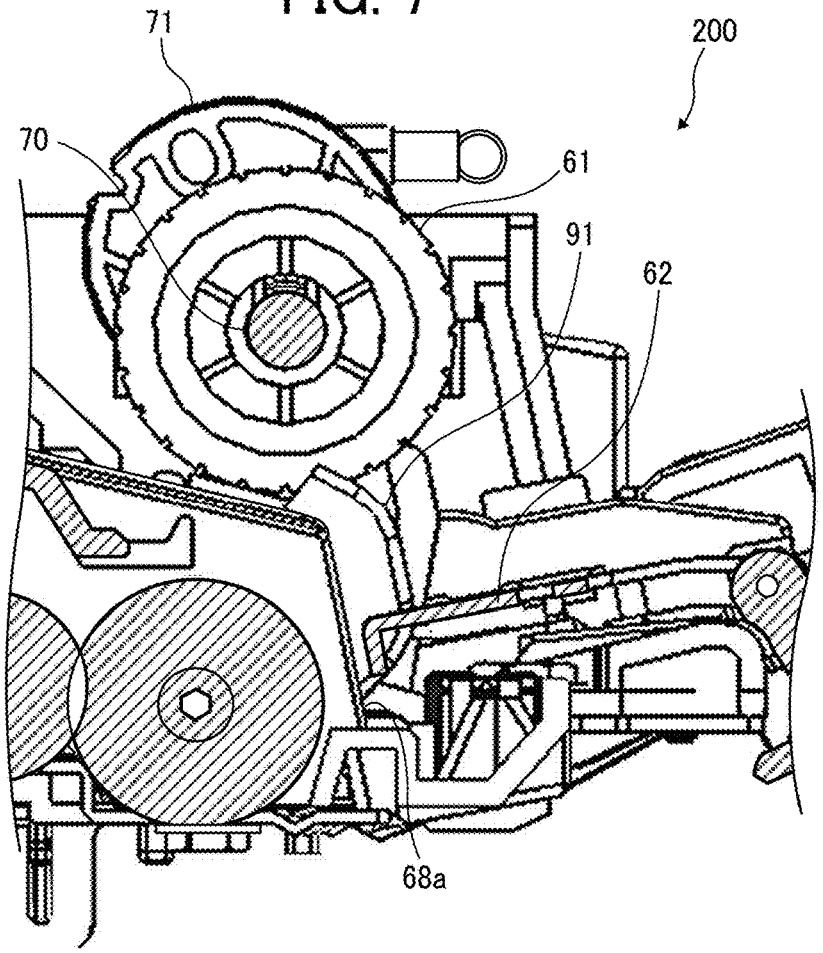
FIG. 7 is a cross-sectional view illustrating the bypass sheet feeding device of FIG. 3, in a state in which a width detection feeler is projected from a wall.

FIG. 7 is a cross-sectional view illustrating the bypass sheet feeding device of FIG. 3, in a state in which a width detection feeler is projected from a wall.

The bypass sheet feeding device further includes a sheet setting detector 84 that detects the setting of the sheet P to the bypass sheet feed tray 69. The sheet setting detector 84 includes a set feeler 84*a* and an optical sensor 84*b* (see FIG. 14). The sheet setting detector 84 functions as a rotary member that is rotatably supported. The optical sensor 84*b* detects a detection target portion 184*b* of the set feeler 84*a*.

The set feeler 84*a* is disposed proximate to the sheet feed roller 61 in the sheet width direction and is projected from a wall 68*a* to which the leading end of the sheet P set on the bypass sheet feed tray 69 contacts.

When the sheet P is set on the bypass sheet feed tray 69, the leading end of the sheet P presses the set feeler 84*a* to rotate the set feeler 84*a*. As the set feeler 84*a* rotates, the detection target portion 184*b* moves from a detection position at which the detection target portion 184*b* is detected by the optical sensor 84*b*, to the retracted position (see FIGS. 14A and 14B). According to this movement of the detection target portion 184*b*, the signal of the optical sensor 84*b* changes to detect that the sheet P is set on the bypass sheet feed tray 69.

In the present embodiment, when performing a printing operation with the sheet P set on the bypass sheet feed tray 69, it is determined whether or not the sheet setting detector 84 detects the setting of the sheet P. When the sheet setting detector 84 has not detected the setting of the sheet P, the control panel 48 displays a message that no sheet is set on the bypass sheet feed tray 69.

Further, the bypass sheet feed tray 69 includes a width detector 90 that detects the width of a sheet set on the bypass sheet feed tray 69. Similar to the sheet setting detector 84, the width detector 90 includes a width detection feeler 91 and an optical sensor 92 (see FIG. 9). The width detection feeler 91 functions as a rotary member that is rotatably supported. The optical sensor 92 detects a detection target portion 91*b* of the width detection feeler 91.

The width detection feeler 91 is spaced away from the sheet feed roller 61 in the sheet width direction and is projected from the wall 68*a* to which the leading end of the sheet set on the bypass sheet feed tray 69 contacts, as illustrated in FIG. 7.

When a sheet having the width equal to or greater than the specified width is set on the bypass sheet feed tray 69, the leading end of the sheet presses the width detection feeler 91 to rotate the width detection feeler 91. As the width detection feeler 91 rotates, the detection target portion 91*b* moves from the retracted position to the detection position at which the detection target portion 91*b* is detected by the optical sensor 92 (see FIGS. 9A and 9B). According to this movement of the detection target portion 91*b*, the signal of the optical sensor 92 changes to detect that the sheet having the width equal to or greater than the specified width is set on the bypass sheet feed tray 69.

In the present embodiment, a space between adjacent sheets in the sheet conveyance direction is changed between a case in which an image is formed on a sheet having the width equal to or greater than the specified width (hereinafter, a large-size sheet) and a case in which an image is formed on a sheet having the width smaller than the specified width (hereinafter, a small-size sheet). When performing a series of printing operations on the small-size sheet having the width smaller than the specified width, heat at the axial ends of the fixing roller 34*a* and the axial ends of the pressure roller 34*b* are not taken by the sheet. Therefore, it is likely that the axial ends of the fixing roller 34*a* and the axial ends of the pressure roller 34*b* have abnormally high temperatures. Therefore, in the present embodiment, the space between adjacent sheets in the sheet conveyance direction is controlled to be more increased when forming an image on a small-size sheet, than a case when forming an image on a large-size sheet. By increasing the space between adjacent sheets in the sheet conveyance direction, the period in which the fixing roller 34*a* is not heated is extended. Extending the period in which the fixing roller 34*a* is not heated extends a period in which heat at the axial ends of the fixing roller 34*a* and heat at the axial ends of the pressure roller 34*b* are naturally dissipated. Therefore, an increase in rise of the temperature at the axial ends of the fixing roller 34*a* and the axial ends of the pressure roller 34*b* is restrained. As a result, the restraint of an increase in rise of the temperature prevents generation of an abnormally high temperature at the axial ends of the fixing roller 34*a* and the axial ends of the pressure roller 34*b* when performing a series of printing operations on the small-size sheet.

The controller 300 (see FIG. 16) of the image forming apparatus 100 determines whether or not to execute control to increase the space between adjacent sheets in the sheet conveyance direction, based on the sheet width size information that is input by a user via the control panel 48. Therefore, even though the sheet size input by the user via the control panel 48 (in other words, an input sheet size) is the large-size sheet having the width equal to or greater than the specified width, in a case in which the sheet actually set on the bypass sheet feed tray 69 is the small-size sheet, it is likely that the axial ends of the fixing roller 34*a* and the axial ends of the pressure roller 34*b* have abnormally high temperatures.

Therefore, in the present embodiment, when the detection result of the width detector 90 does not match the sheet width size input via the control panel 48 (in other words, an input sheet width size), the control panel 48 displays a message indicating that the detection result does not match the sheet width size input via the control panel 48 to encourage the user to set a sheet that matches the sheet width size input via the control panel 48, on the bypass sheet feed tray 69.

The pair of side fences 69*a* of the bypass sheet feed tray 69 is manually moved in the sheet width direction to regulate the sheet set on the bypass sheet feed tray 69, in the width direction. Therefore, users may forget to move the pair of side fences 69*a*, and therefore the sheet may be set on the bypass sheet feed tray 69 in a skewed state. As a result, it was likely to be erroneously determined that the sheet size set on the bypass sheet feed tray 69 (in other words, a set sheet size) does not match the sheet size input via the control panel 48 (input sheet size) although the sheet size set on the bypass sheet feed tray 69 matches the sheet size input via the control panel 48 or vice versa.

Figure 8:
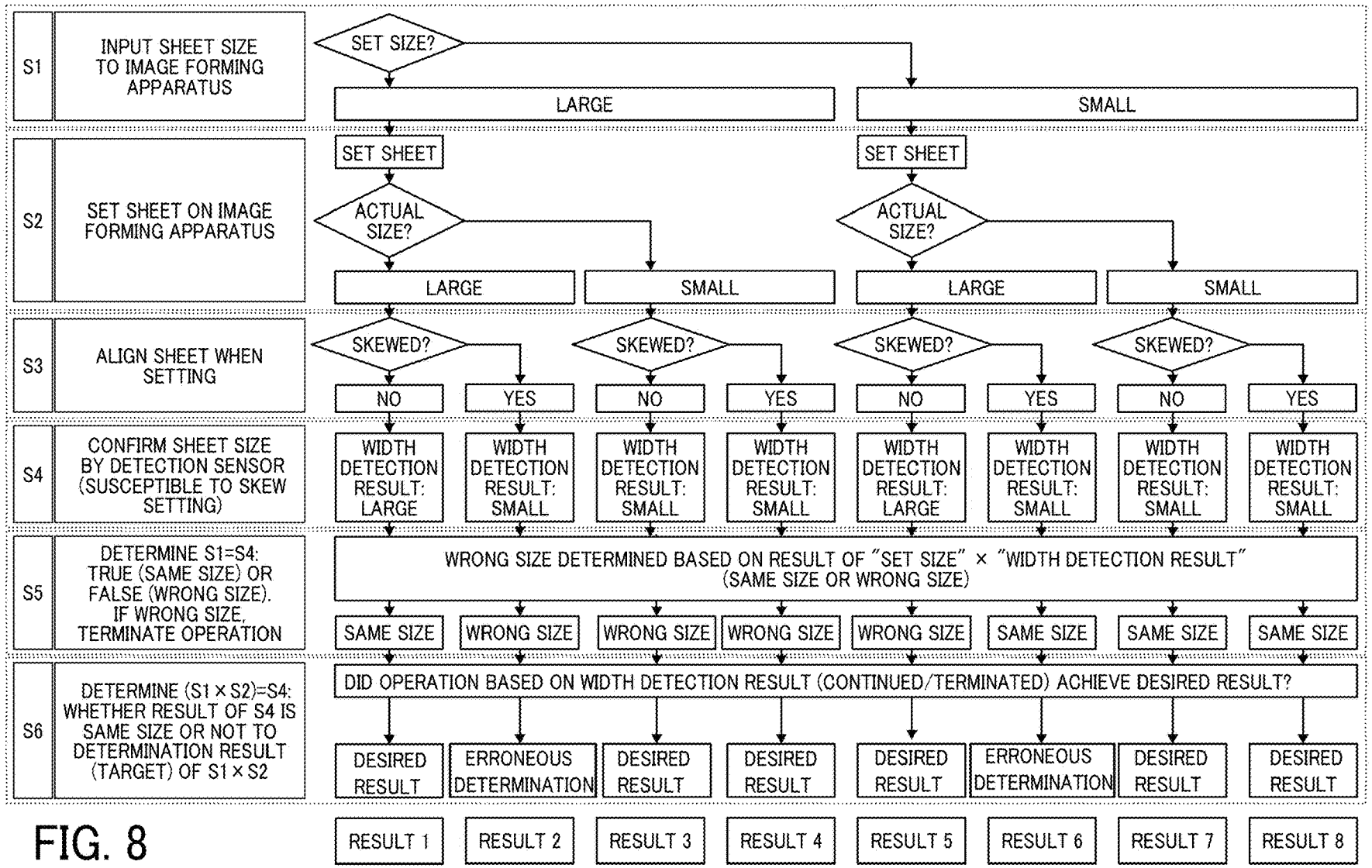
FIG. 8 is a flowchart of a known sheet size determination flow.

FIG. 8 is a flowchart of a known sheet size determination flow.

As described in the flow of Result 2 illustrated in FIG. 8, even though the input sheet size is large size (LARGE in step S1 in the flow of FIG. 8) and the set sheet size set on the bypass sheet feed tray 69 (LARGE in step S2 in the flow of FIG. 8), in a case in which the sheets on the bypass sheet feed tray 69 are skewed without performing sheet alignment on the sheets by contacting the pair of side fences 69*a* to both ends in the sheet width direction (YES in step S3 in the flow of FIG. 8), the leading end of the sheet does not press the width detection feeler 91, and therefore the detection result of the width detector 90 is erroneously determined that the small-size sheet is set on the bypass sheet feed tray 69 (WIDTH DETECTION RESULT: SMALL in step S4 in the flow of FIG. 8). As a result, even though the input sheet size is large size and the set sheet size set on the bypass sheet feed tray 69 is also large size, it is erroneously determined that the input sheet size and the set sheet size are different from each other (WRONG SIZE in step S5 and ERRONEOUS DETERMINATION in step S6 in the flow of FIG. 8). Consequently, the control panel 48 displays the message indicating that the sheet size on the bypass sheet feed tray 69 does not match the input sheet width size.

Further, as indicated in the flow of Result 6 illustrated in FIG. 8, even though the input sheet size is small size (SMALL in step S1 in the flow of FIG. 8) and the set sheet size set on the bypass sheet feed tray 69 (LARGE in step S2 in the flow of FIG. 8), in a case in which the large-size sheets are set on the bypass sheet feed tray 69 in the skewed state without performing sheet alignment on the sheets by contacting the pair of side fences 69*a* to both ends in the sheet width direction (YES in step S3 in the flow of FIG. 8), the detection result of the width detector 90 is erroneously determined that the small-size sheet is set on the bypass sheet feed tray 69 (WIDTH DETECTION RESULT: SMALL in step S4 in the flow of FIG. 8). As a result, it is erroneously determined that the sheet size set on the bypass sheet feed tray 69 is small size and is same as the input sheet size (SAME SIZE in step S5 and ERRONEOUS DETERMINATION in step S6 in the flow of FIG. 8).

Therefore, a second width detector may be disposed in a bypass sheet conveyance passage extending from the sheet feed roller 61 to the pair of registration rollers 32, at the same position as the width detector 90 in the sheet width direction, so that the second width detector detects whether the sheet set on the bypass sheet feed tray 69 is the large-size sheet setting in the skewed state or the small-size sheet setting. In the large-size sheet setting in the skewed state, the second width detector detects the sheet to be conveyed. Therefore, it is determined that the sheet setting is the large-size sheet setting in the skewed state. On the other hand, when the second width detector does not detect the sheet even at the predetermined timing, it is determined that the sheet setting is the small-size sheet setting.

However, since the second width detector is provided separately in addition to the width detector 90, this addition of the second width detector is likely to result in an increase in the cost of the image forming apparatus due to an increase in the number of parts of the image forming apparatus.

Therefore, in the present embodiment, in order to prevent the occurrence of such an erroneous determination, the width detector 90 determines whether the sheet is a large-size sheet setting in the skewed state or a small-size sheet setting.

Figure 9A:
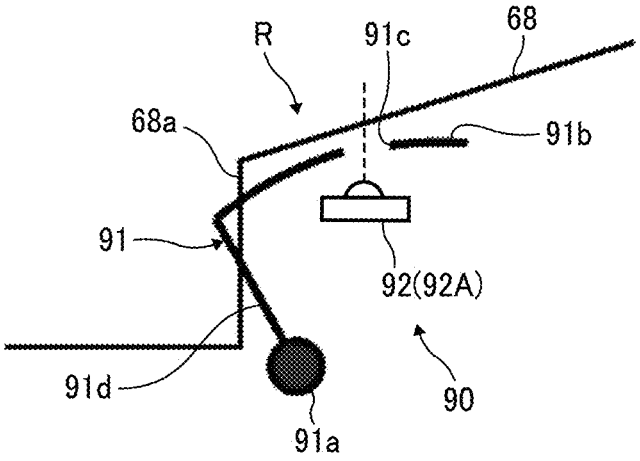
FIGS. 9A, 9B, and 9C are cross-sectional views, each illustrating a width detector according to the present embodiment.
Figure 9B:
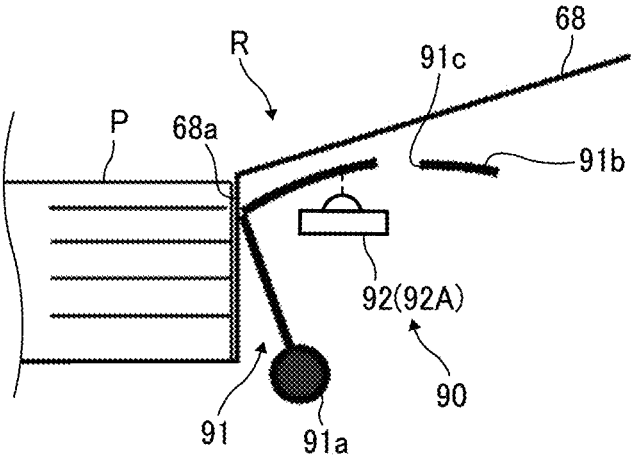
Figure 9C:
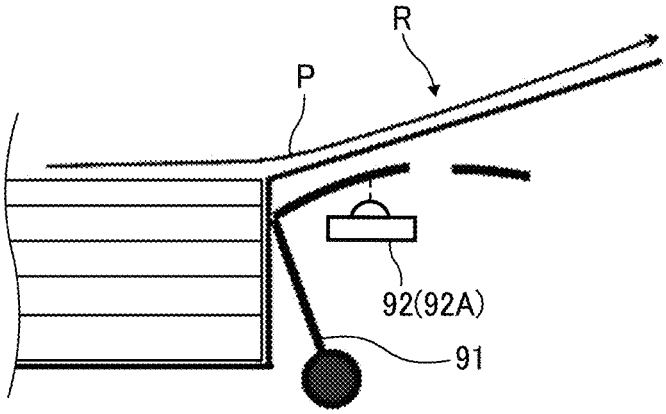

FIGS. 9A, 9B, and 9C are cross-sectional views each illustrating the width detector 90 according to the present embodiment.

Figure 10:
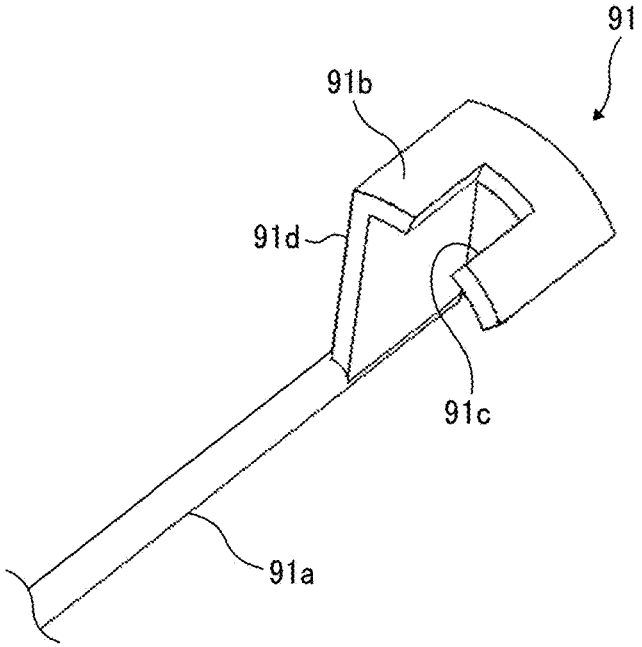
FIG. 10 is a perspective view illustrating a main part of the width detection feeler of the width detector.

FIG. 10 is a perspective view illustrating a width detection feeler 91 of the width detector 90 according to the present embodiment.

Figure 11:
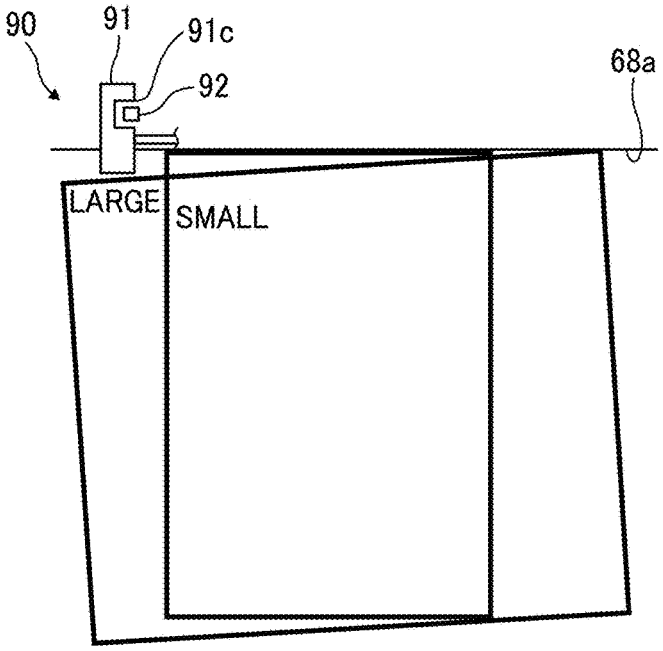
FIG. 11 is a schematic plan view illustrating the width detector when performing a skew setting of a large size sheet and a setting of a small size sheet.

FIG. 11 is a schematic plan view illustrating the width detector 90 when performing a skew setting of a large size sheet and a setting of a small size sheet.

FIG. 9A is a schematic cross-sectional view of the width detector 90 in the sheet skew setting of a large-size sheet and a sheet setting of a small-size sheet.

FIG. 9B is a schematic cross-sectional view of the width detector 90 in the sheet normal setting of the large-size sheet (that is, when the sheet is set by alignment by a pair of side fences).

FIG. 9C is a schematic cross-sectional view of the width detector 90 in a state of sheet conveyance of the large-size sheet in the sheet normal setting.

The width detector 90 according to the present embodiment includes the optical sensor 92 that is a reflection-type optical sensor in which light emitted by the light emitting unit is irradiated to the bypass sheet conveyance passage R that functions as a sheet conveyance passage. Accordingly, the light emitted from the light receiving unit of the optical sensor 92 reflected on the sheet in the bypass sheet conveyance passage R is received by the light receiving unit of the optical sensor 92, thereby detecting the sheet in the bypass sheet conveyance passage R.

As illustrated in FIG. 10, the width detection feeler 91 of the width detector 90 includes a rotary shaft 91*a* and a sheet contact face 91*d*. The rotary shaft 91*a* is rotatably supported by the bypass sheet feeding device. When a sheet is set on the bypass sheet feed tray 69 that extends from one end of the rotary shaft 91*a* in a direction orthogonal to the axial direction of the rotary shaft 91*a*, the leading end of the large-size sheet set on the bypass sheet feed tray 69 contacts the sheet contact face 91*d*. The detection target portion 91*b* is disposed at the distal end of the sheet contact face 91*d* and extends in the sheet conveyance direction. The detection target portion 91*b* has a cutout 91*c* through which light emitted from the optical sensor 92 passes.

Similar to the width detection feeler 91, the width detection feeler 91 of the width detector 90 is biased by a biasing member such as a torsion spring, to rotate in the counterclockwise direction in FIGS. 9A to 9C. In the initial state, the cutout 91*c* is located in the detection area of the optical sensor 92 and the detection target portion 91*b* of the width detection feeler 91 is retracted from the detection area.

When a small-size sheet is set on the bypass sheet feed tray 69 and when a large-size sheet is skewed (sheet skew setting), the leading end of the small-size sheet does not press the sheet contact face 91*d*, as illustrated in FIGS. 9A and 11. Therefore, the width detection feeler 91 remains at the initial position and the light emitted by the optical sensor 92 is irradiated to the bypass sheet conveyance passage R via the cutout 91*c*. Therefore, as can be seen from FIG. 11, when the sheet is fed by performing the sheet feeding operation, in a case in which the large-size sheet is set in the skewed state, the light irradiated from the optical sensor 92 is reflected on the sheet, and the light receiving unit of the optical sensor 92 receives the light. Accordingly, it is determined that the large-size sheet setting is in the skewed state.

As can be seen from FIG. 11, the lateral end of the small-size sheet is located at a position closer to the center in the sheet width direction, than the optical sensor 92 of the width detector 90. Therefore, even if a small-size sheet is fed by performing the sheet feeding operation, the optical sensor 92 does not detect the small-size sheet. Consequently, even if the timing reaches the specified timing, in a case in which the optical sensor 92 does not detect the sheet, it is determined that the sheet set on the bypass sheet feed tray 69 is a small-size sheet.

On the other hand, as illustrated in FIG. 9B, when the pair of side fences 69*a* aligns the sheet to deskew the sheet on the bypass sheet feed tray 69 and set the sheet appropriately, the leading end of the sheet presses the sheet contact face 91*d* to rotate the width detection feeler 91 in the clockwise direction in FIG. 9B. By so doing, the detection target portion 91*b* moves to the detection area of the optical sensor 92, so that the optical sensor 92 detects the detection target portion 91*b* of the width detection feeler 91. Consequently, the optical sensor 92 detects the detection target portion 91*b*, and therefore detects that the large-size sheet is appropriately set on the bypass sheet feed tray 69.

As illustrated in FIG. 9C, when the large-size sheet is appropriately set, the detection target portion 91*b* blocks the light of the optical sensor 92. Therefore, at this time, even if the sheet is fed by performing the sheet feeding operation, the signal of the optical sensor 92 does not change, and therefore the sheet is not detected. However, at this time, it is confirmed that the large-size sheet has already been set, and there is no need to determine whether or not the large-size sheet is set in the skewed state, based on whether or not the optical sensor 92 detects the sheet in the bypass sheet conveyance passage R. Therefore, there is no problem even if the optical sensor 92 is unable to detect the sheet in the bypass sheet conveyance passage R.

As described above, in the present embodiment, the setting of the small-size sheet, the setting of the large-size sheet in the skewed state, and the setting of the large-size sheet in the normal state are discriminated, without increasing the number of parts. According to this configuration, an increase in cost of the image forming apparatus 100 is prevented.

Figures 12, 12A:
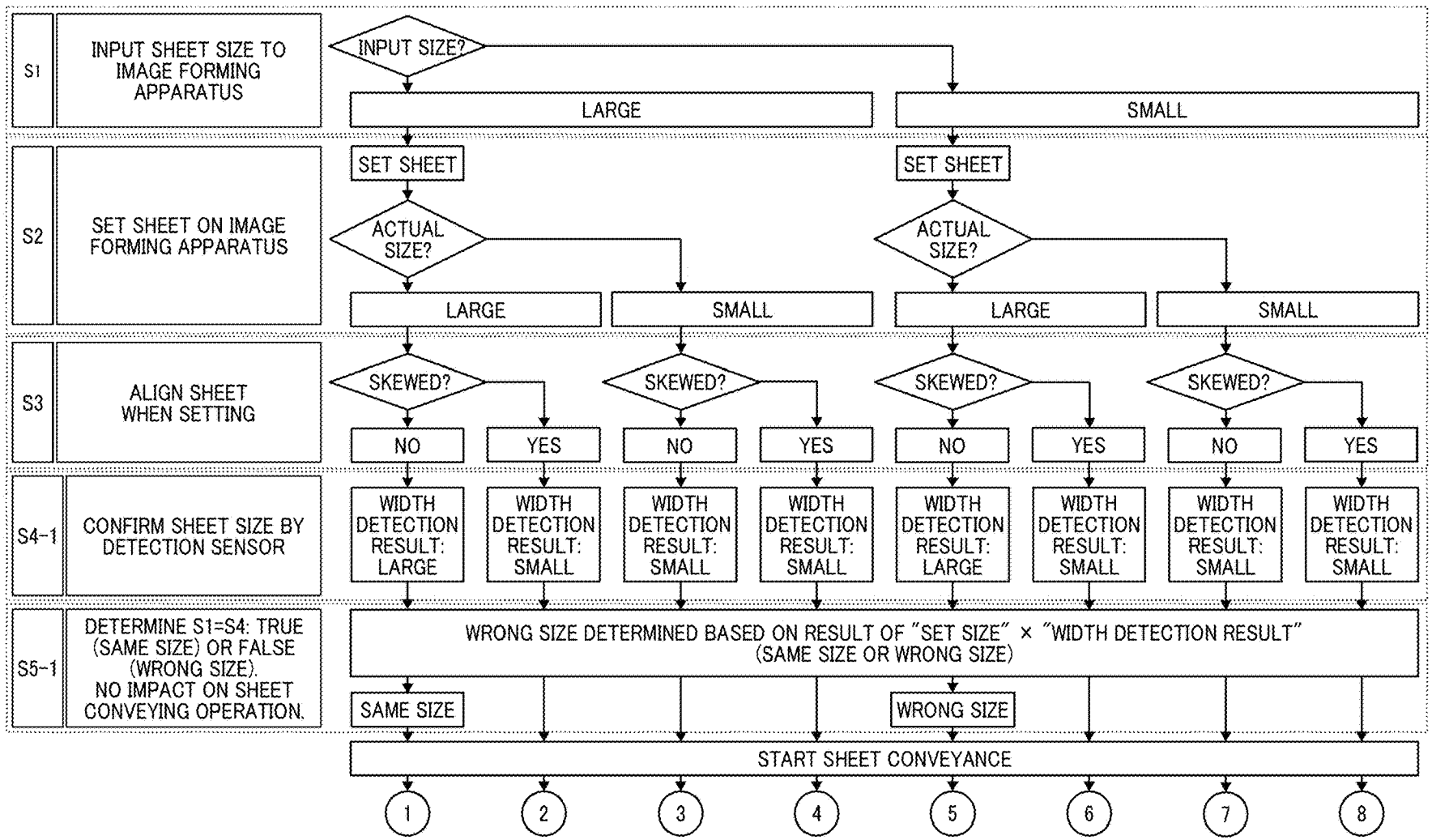
FIG. 12 including
FIGS. 12A and 12B is a diagram illustrating a sheet side determination flow according to the present embodiment.
Figure 12B:
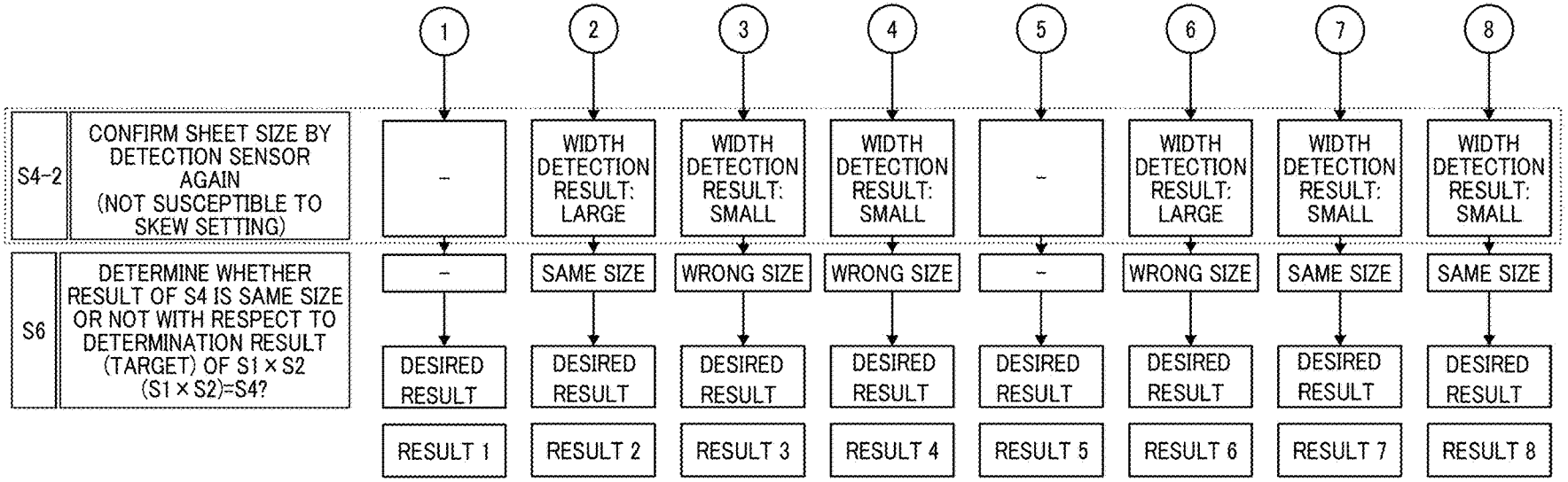

FIG. 12 including FIGS. 12A and 12B is a diagram illustrating a sheet side determination flow according to the present embodiment.

Note that, since steps S1 to S3 in the flowchart of FIG. 12A performs the same operations as steps S1 to S3 in the flowchart of FIG. 8, the descriptions of the operations in steps S1 to S3 in the flowchart of FIG. 12A are omitted. In the present embodiment, the controller 300 causes the optical sensor 92 to detect the detection target portion 91*b* of the width detection feeler 91, so that the width detector 90 detects the setting of the sheet, in step S4-1 in the flowchart of FIG. 12A. When the width detector 90 detects (confirms) the setting of the large-size sheet (WIDTH DETECTION RESULT: LARGE in step S4-1), the controller 300 determines whether or not the input sheet size and the set sheet size are different (step S5-1 in the flowchart of FIG. 12A).

On the other hand, when the optical sensor 92 of the width detector 90 does not detect the detection target portion 91*b* of the width detection feeler 91 and the width detector 90 detects (confirms) the setting of the small-size sheet (WIDTH DETECTION RESULT: SMALL in step S4-1), the controller 300 causes the sheet feed roller 61 to perform the sheet feeding operation, and determines whether the sheet is the large-size sheet or the small-size sheet, based on the detection result of the sheet by the optical sensor 92 in step S4-2 in the flowchart of FIG. 12B. Then, the controller 300 determines whether or not the determination result of the sheet (large or small) based on the detection result of the optical sensor 92 matches the input sheet size. As a result, as indicated by Result 2, in a case in which the input sheet size is the large size (LARGE in step S1 in the flowchart of FIG. 12A) and the large-size sheet set on the bypass sheet feed tray 69 in the skewed state (LARGE in step S2 and SKEWED?: YES in step S3, in the flowchart of FIG. 12A), it is determined that the input sheet size matches the set sheet size, achieving a desired result (step S6 in the flowchart of FIG. 12B). As a result, as indicated by Result 6, in a case in which the input sheet size is the small size (SMALL in step S1 in the flowchart of FIG. 12A) and the large-size sheet set on the bypass sheet feed tray 69 in the skewed state (LARGE in step S2 and SKEWED?: YES in step S3, in the flowchart of FIG. 12A), it is determined as the wrong size in which the input sheet size does not match the set sheet size, achieving a desired result (step S6 in the flowchart of FIG. 12B).

When it is determined that the input sheet size is a large-size sheet and the set sheet size is a small-size sheet (Result 3 and Result 4 in the flowchart of FIG. 12B), if the printing operation is continuously performed, it is likely that the axial ends of the fixing roller 34*a* and the axial ends of the pressure roller 34*b* increase in temperature to have high temperatures. Therefore, at this time, the controller 300 stops the image forming operation and causes the control panel 48 to display a message indicating that the width size of the sheet set on the bypass sheet feed tray 69 does not match the sheet width size input by a user via the control panel 48 and another message encouraging the user to set a sheet having the width size that matches the input sheet width size, on the bypass sheet feed tray 69.

On the other hand, when it is determined that the input sheet size is a small-size sheet and the set sheet is a large-size sheet (Result 5 and Result 6 in the flowchart of FIG. 12B), the image is formed within the image forming area of the sheet without printing the image out of the sheet and the temperature at the axial ends of the fixing roller 34*a* and the temperature at the axial ends of the pressure roller 34*b* do not increase. Therefore, the printing operation is continuously performed and, after completion of the printing operation, the controller 300 causes the control panel 48 to display the message indicating that the width size of the sheet set on the bypass sheet feed tray 69 does not match the sheet width size input by the user via the control panel 48. As in the operations of Result 3 and Result 4 in the flowchart of FIG. 12B, the controller 300 may stop the image forming operation and cause the control panel 48 to display the message indicating that the width size of the sheet set on the bypass sheet feed tray 69 does not match the input sheet width size and another message encouraging the user to set a sheet having the width size that matches the input sheet width size, on the bypass sheet feed tray 69.

In addition, for example, when the optical sensor 92 detects the detection target portion 91*b* of the width detection feeler 91 and the controller 300 determines that the sheet size is a large-size sheet (WIDTH DETECTION RESULT: LARGE in step S4-1) and the same size as the input sheet size (SAME SIZE in step S5-1), which is Result 1 in the flowchart of FIG. 12B, the controller 300 starts the image forming operation immediately. On the other hand, when the optical sensor 92 does not detect the detection target portion 91*b* of the width detection feeler 91 and the controller 300 determines that the sheet size is a small-size sheet (WIDTH DETECTION RESULT: SMALL in step S4-1), the controller 300 causes the optical sensor 92 to detect the sheet to determine whether the sheet is a large-size sheet or a small-size sheet. When the set sheet size is the same size as the input sheet size (Result 2, Result 7, and Result 8), the controller 300 may start the image forming operation.

In addition, in the case of Result 3 and Result 4 (INPUT SIZE: LARGE in step S1 and ACTUAL SIZE: SMALL in step S2 in the flowchart of FIG. 12A), in order to fit the image on the small-size sheet, the size of the image to be formed on the sheet is reduced before forming the image on the small-size sheet and, at the same time, the setting of the interval between adjacent sheets is changed to the setting of the interval for the small-size sheet to continue the image forming operation. In addition, in the case of Result 5 and Result 6 (INPUT SIZE: SMALL in step S1 and ACTUAL SIZE: LARGE in step S2 in the flowchart of FIG. 12A), in order to fit the image on the small-size sheet, the size of the image to be formed on the sheet is increased before forming the image on the large-size sheet and, at the same time, the setting of the interval between adjacent sheets is changed to the setting of the interval for the large-size sheet to continue the image forming operation.

Further, the skew amount of the large-size sheet may be measured based on the detection result of the optical sensor 92, and the skew correction (sheet deskew) may be performed based on the measured skew amount.

Figure 13:
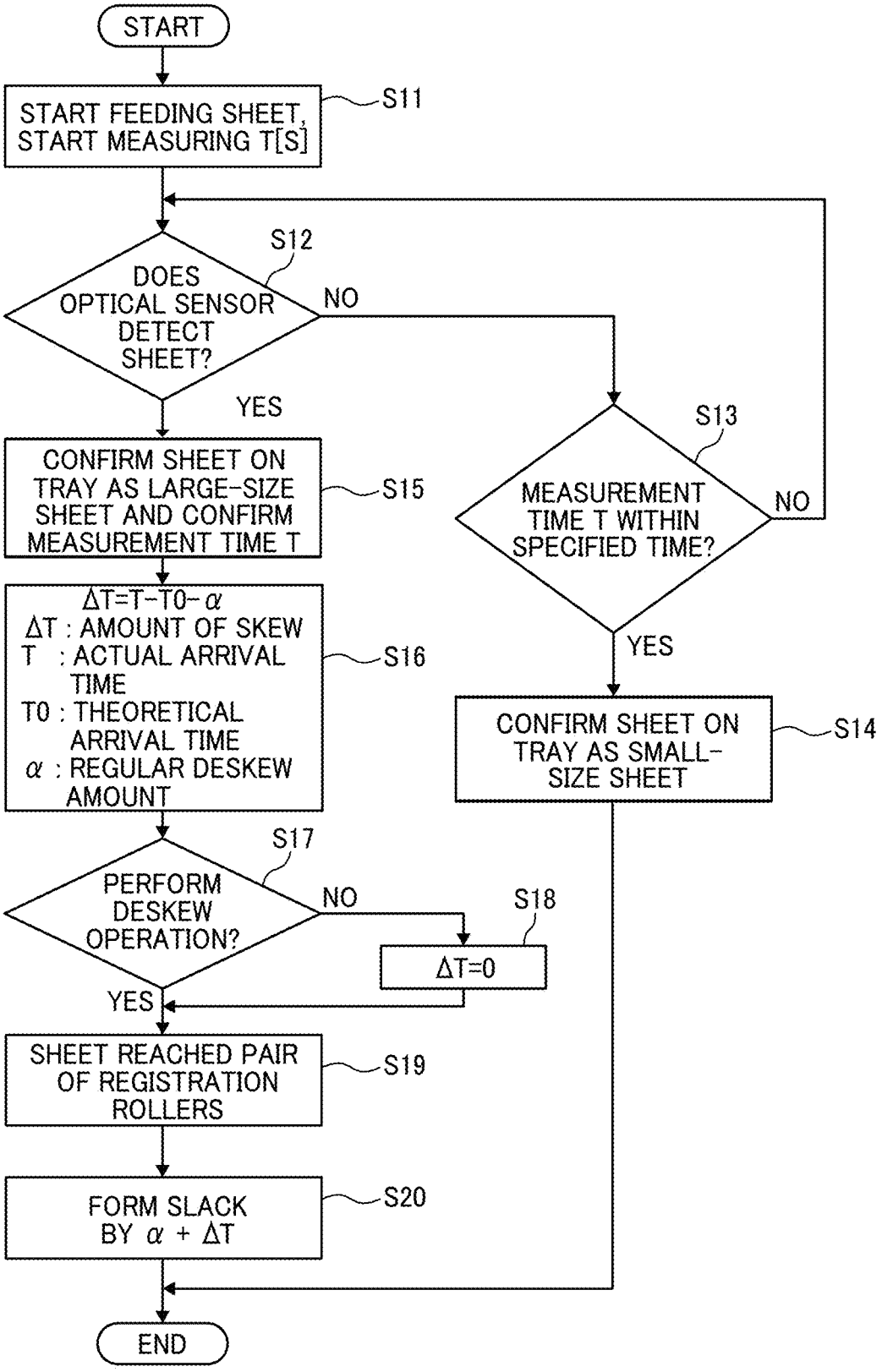
FIG. 13 is a flowchart illustrating a flow of a large size sheet deskew operation.

FIG. 13 is a flowchart of a deskewing operation of the large-size sheet.

When the controller 300 causes the drive motor 85 to turn on and the sheet feed roller 61 to rotate to start feeding the sheet, the timer turns on to start measuring the time T[s] (step S11). Then, the controller 300 (see FIG. 16) of the image forming apparatus 100 monitors whether or not the optical sensor 92 detects the sheet within a specified time (steps S12 and S13). When the optical sensor 92 does not detect the sheet within the specified time (NO in step S13), the operation in step S13 is repeated until the optical sensor 92 detects the sheet within the specified time. When the optical sensor 92 does not detect the sheet within the specified time (NO in step S12 and YES in step S13), the controller 300 determines that the size of the sheet set on the bypass sheet feed tray 69 is a small-size sheet (step S14), and the operation of the flow ends.

By contrast, when the optical sensor 92 detects the sheet within the specified time (YES in step S12), the controller 300 determines that the size of the sheet set on the bypass sheet feed tray 69 is a large-size sheet and, at the same time, stops the timer to confirm the measurement time T[s] (step S15). The measurement time T[s] corresponds to an actual arrival time.

Next, the controller 300 of the image forming apparatus 100 calculates the skew amount ΔT (step S16). The skew amount ΔT is expressed as $\Delta T = T - T0 - \alpha$, where "T0" represents a theoretical arrival time at which the large-size sheet reaches the optical sensor 92 in a state in which the leading end of the large-size sheet is not skewed and "α" represents a regular deskew amount with which the skew of the sheet is deskewed by contacting the leading end of the sheet to the pair of registration rollers 32 and bend (warp) by a predetermined amount. Then, the controller 300 determines whether or not to perform an additional skew correction (deskew operation) in step S17. When the skew amount ΔT exceeds zero (0), additional skew correction (deskew operation) is set (YES in step S17). When the registration sensor 32*a* detects that the leading end of the sheet reaches the pair of registration rollers 32 (step S19), the sheet conveying roller upstream from the pair of registration rollers 32 in the sheet conveyance direction is rotated to form a slack by the time of the regular deskew amount α and the skew amount ΔT to deskew the sheet (step S20).

On the other hand, when the skew amount ΔT is equal to or below 0, the additional skew correction (deskew operation) is not set (NO in step S17) and it is determined that the skew amount equals to zero (0), that is, $\Delta T = 0$ (step S18). Then, when the registration sensor 32*a* detects that the leading end of the sheet reaches the pair of registration rollers 32 (step S19), the regular skew correction (deskew operation) is performed, in other words, the sheet conveying roller upstream from the pair of registration rollers 32 in the sheet conveyance direction is rotated to form a slack by the time of the regular deskew amount α and the skew amount ΔT to deskew the sheet (step S20).

As a result, even when the large-size sheet is loaded on the bypass sheet feed tray 69 in the skewed state, the sheet is reliably deskewed by performing the sheet feeding operation. Accordingly, an image to be formed on the large-size sheet is prevented from being formed obliquely to the large-size sheet.

The measurement time T[s] may vary depending on the start position of the sheet, the slip ratio, and the conveyance speed of the sheet. Therefore, it is preferable to calculate the skew amount ΔT in consideration of the sheet correction amount (deskew amount) related to the use condition such as the sheet type or the environment. For example, the diameter of the sheet feed roller 61 varies due to variations in parts and components and wear caused by use over time, thereby changing the conveying speed of the sheet. In addition, the slip ratio varies depending on the type, thickness, and stiffness of the sheet and contamination on the surface of the sheet feed roller 61.

In addition, the sheet start position changes depending on the position of the subsequent sheet at which the preceding sheet conveys the leading end of the subsequent sheet, and therefore the measurement time T[s] changes depending on the distance from the leading end of the sheet on the bypass sheet tray to the detection position of the optical sensor. Further, the distance also changes due to variation of the detection position of the optical sensor 92 and variation of the position of each part. The measurement time T[s] is likely to vary due to variation in the rotation start timing (start timing of feeding the sheet) of the sheet feed roller 61 caused by variation in the coupling of the electromagnetic clutch.

Due to such variations, the skew correction (deskew operation) may rather deteriorate the image skew to the sheet. Therefore, the user may be allowed to set whether or not to perform the deskew operation on the large-size sheet. In this case, the user operates the control panel 48 to set whether or not to perform the skew correction (deskew operation) on the large-size sheet. Alternatively, the user may operate a personal computer in which a printer driver application software is installed, to set whether or not to perform the skew correction (deskew operation) on the large-size sheet.

In addition, the image forming apparatus 100 may provide a theoretical arrival time correction mode to correct (adjust) the theoretical arrival time T0. For example, the theoretical arrival time correction mode is executed before factory shipping or the setting of a user-end apparatus in the customer's office by a service representative, so as to correct (adjust) the theoretical arrival time T0. As a result, a decrease in the calculation accuracy of the skew amount ΔT caused by variation in the measurement time T[s] by the characteristics of each apparatus such as positional variation of each part or component.

Further, at the time of regular maintenance of the apparatus, the service representative executes the theoretical arrive time correction mode to correct the theoretical arrive time T0, thereby preventing or restraining the change in the diameter of the sheet feed roller 61 due to wear by use over time and the deterioration in calculation accuracy of the skew amount ΔT due to the change of the characteristics of each apparatus by use over time caused by contamination on the surface of the sheet feed roller 61.

In addition, a plurality of correction values corresponding to the type, thickness, and stiffness of the sheet may be stored, so that a corresponding correction value may be read based on the type, thickness, and stiffness of the sheet input to the control panel by a user to correct the measurement time T[s]. This correction of the measurement time T[s] prevents or restrains a decrease in the calculation accuracy of the skew amount ΔT caused by variation in the measurement time T[s] according to the type, thickness, and stiffness of the sheet.

When executing the theoretical arrive time correction mode, as advance preparations, for example, the width detection feeler 91 is shifted in the sheet width direction so that the detection target portion 91*b* does not block the light of the optical sensor 92 when the large-size sheet is appropriately set. In addition, a dedicated jig may be set on the bypass sheet feed tray 69 to prevent the width detection feeler 91 from being pressed by the large-size sheet when the large-size sheet is set appropriately on the bypass sheet feed tray 69, so that the detection target portion 91*b* may not block the light of the optical sensor 92.

Next, when the large-size sheet is set on the bypass sheet feed tray 69, the control panel 48 is operated to execute the theoretical arrival time correction mode to measure the time from the start of feeding of the sheet to the detection of the sheet by the optical sensor 92. Then, the measured time is stored in the memory as the corrected theoretical arrive time T0. This time measurement may be performed a plurality of times to store the average value of the measured times in the memory as the corrected theoretical arrive time T0.

In addition, another optical sensor (e.g., an optical sensor 92) may be disposed on the opposite side of the position of the optical sensor 92 across the center in the sheet width direction to calculate the skew amount ΔT based on the two optical sensors (i.e., the optical sensors 92 and 92A). In the above-described configuration, the skew amount ΔT is obtained from the time from when one of the two optical sensors (i.e., the optical sensors 92 and 92A) detects the sheet to when the other optical sensor detects the sheet. In the above-described configuration, impacts caused by variation in the start of rotation of the sheet feed roller 61 (start timing of the sheet feeding operation) and variation in the sheet start position generated by the position of the leading end of the subsequent sheet picked by the preceding sheet are negligible, and therefore the detection accuracy of the skew amount ΔT is enhanced.

In addition, the optical sensor 84*b* of the sheet setting detector 84 may be configured to detect a sheet in the bypass sheet conveyance passage R, so that the sheet setting detector 84 may perform the sheet setting detection and the sheet skew detection.

Figure 14A:
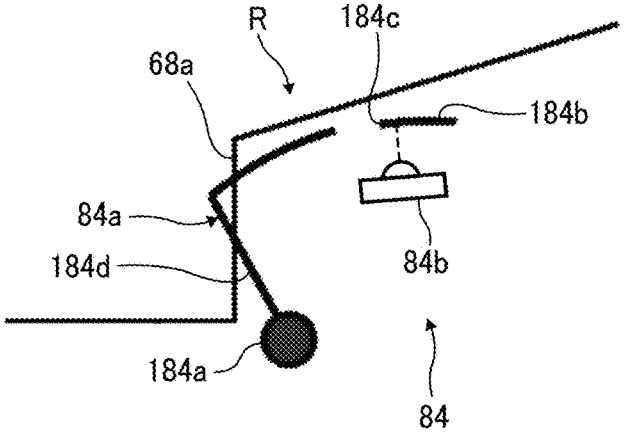
FIGS. 14A, 14B, and 14C are schematic cross-sectional views, each illustrating a sheet setting detector.
Figure 14B:
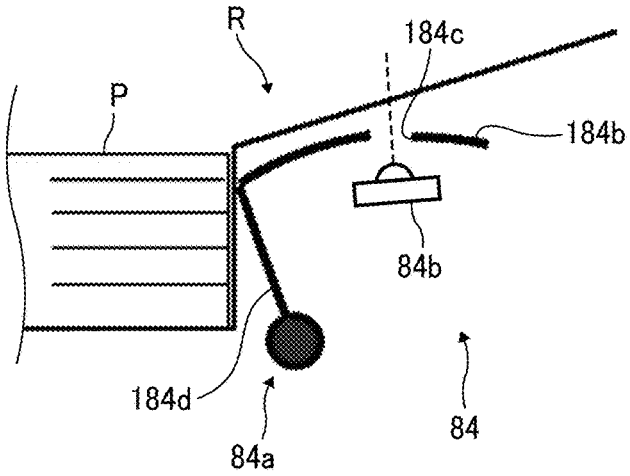
Figure 14C:
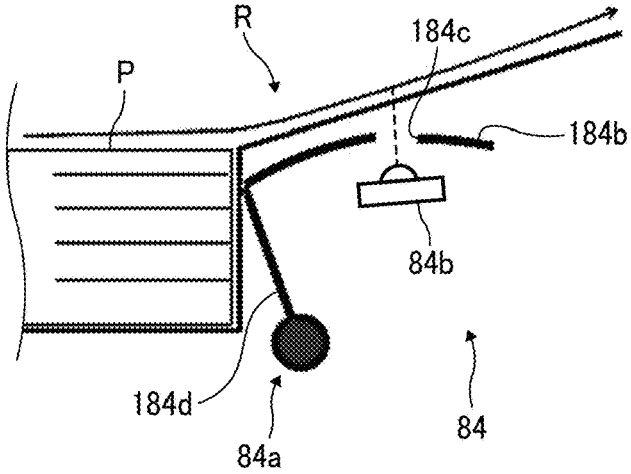

FIGS. 14A, 14B, and 14C are schematic cross-sectional views, each illustrating the sheet setting detector 84.

FIG. 14A is a schematic cross-sectional view of the sheet setting detector 84 before the sheet is set on the bypass sheet feed tray 69.

FIG. 14B is a schematic cross-sectional view of the sheet setting detector 84 after the sheet is set on the bypass sheet feed tray 69.

FIG. 14C is a schematic cross-sectional view of the sheet setting detector 84 in the sheet conveyance.

As illustrated in FIGS. 14A to 14C, the sheet setting detector 84 includes a set feeler 84*a* and a reflection-type optical sensor 84*b*. Similar to the optical sensor 92 of the width detector 90, the optical sensor 84*b* of the sheet setting detector 84 is disposed so that the light emitted from the light emitting unit is irradiated to the bypass sheet conveyance passage R. Further, in order to detect the skew of the small-size sheet, the optical sensor 84*b* of the sheet setting detector 84 is disposed at a position closer to the center in the sheet width direction, than the optical sensor 92 of the width detector 90. Further, the optical sensor 84*b* of the sheet setting detector 84 is disposed upstream from the registration sensor 32*a* in the sheet conveyance direction.

Similar to the width detection feeler 91, the set feeler 84*a* of the sheet setting detector 84 includes a rotary shaft 184*a* and a sheet contact face 184*d*. The rotary shaft 184*a* is rotatably supported by the bypass sheet feeding device. When a sheet is set on the bypass sheet feed tray 69 that extends from one end of the rotary shaft 184*a* in a direction orthogonal to the axial direction of the rotary shaft 184*a*, the leading end of the sheet set on the bypass sheet feed tray 69 contacts the sheet contact face 184*d*. The detection target portion 184*b* is disposed at the distal end of the sheet contact face 184*d* and extends in the sheet conveyance direction. The detection target portion 184*b* has a cutout 184*c* through which light emitted from the optical sensor 84*b* passes.

Also similar to the width detection feeler 91, the set feeler 84*a* of the sheet setting detector 84 is biased by a biasing member such as a torsion spring, in a direction to rotate in the counterclockwise direction in FIGS. 14A to 14C. A part of the sheet contact face 184*d* projects from the wall 68*a* to which the leading end of the sheet set on the bypass sheet feed tray 69 contacts.

Different from the width detection feeler 91, the detection target portion 184*b* of the set feeler 84*a* is located at a position in the detection area of the optical sensor 84*b* in the initial state.

When the sheet is set on the bypass sheet feed tray 69, as illustrated in FIG. 14B, the leading end of the sheet presses the set feeler 84*a* to rotate the set feeler 84*a* in the clockwise direction in FIG. 14B. In response to the rotation of the set feeler 84*a*, the detection target portion 184*b* retracts from the detection area of the optical sensor 84*b*, and the cutout 184*c* of the set feeler 84*a* is brought to locate in the detection area. Consequently, the optical sensor 84*b* does not detect the detection target portion 184*b*, and therefore detects that the sheet is set on the bypass sheet feed tray 69.

Further, as illustrated in FIG. 14B, in response to the setting of the sheet on the bypass sheet feed tray 69, the detection target portion 184*b* is retracted from the detection area of the optical sensor 84*b*, and the light emitted from the light emitting unit of the optical sensor 84*b* is irradiated to the bypass sheet conveyance passage R. Accordingly, as illustrated in FIG. 14C, the light of the optical sensor 84*b* is irradiated to the sheet conveyed to the bypass sheet conveyance passage R by the sheet feed roller 61, and the light reflected from the sheet is received by the light receiving unit of the optical sensor 84*b* to detect whether the sheet is in the bypass sheet conveyance passage R.

Figure 15:
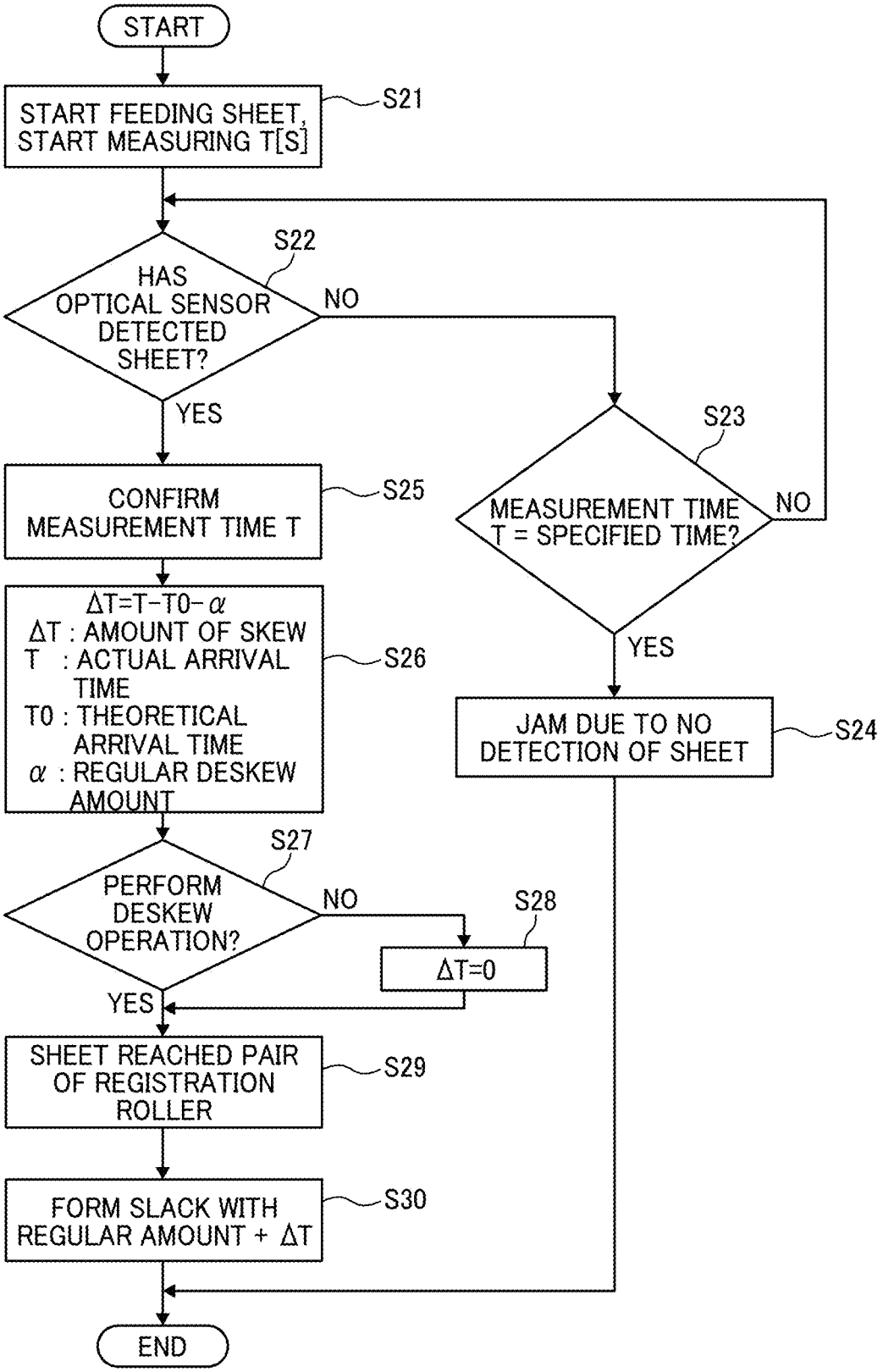
FIG. 15 is a flowchart illustrating a flow of detecting the amount of skew by an optical sensor of the sheet setting detector and deskewing the sheet.

FIG. 15 is a flowchart illustrating a flow of detecting the skew amount of the sheet by the optical sensor 84*b* of the sheet setting detector 84 and of correcting the skew of the sheet, in other words, of performing the deskewing operation on the sheet.

When the controller 300 causes the drive motor 85 to turn on and the sheet feed roller 61 to rotate to start feeding the sheet, the time T[s] is measured. Next, the controller 300 (see FIG. 16) of the image forming apparatus 100 monitors whether or not the optical sensor 84*b* detects the sheet within a specified time (steps S22 and S23). When the optical sensor 84*b* does not detect the sheet within the specified time (NO in step S22 and YES in step S23), the controller 300 determines that a sheet undelivered jam occurs (step S24), and ends the sheet feeding operation.

As described above, the controller 300 determines the sheet undelivered jam based on the detection result of the optical sensor 84*b* of the sheet setting detector 84 disposed upstream from the registration sensor 32*a* in the sheet conveyance direction. Therefore, when compared with a case in which the sheet undelivered jam is determined using the registration sensor 32*a*, the sheet undelivered jam is detected at an earlier stage. Accordingly, the sheet undelivered jam is detected when the leading end of the sheet is still in or close to the bypass sheet feed tray 69, thereby simplify the paper jam handling.

On the other hand, when the optical sensor 84*b* detects the sheet within the specified time (YES in step S22), similar to the skew correcting operation using the optical sensor 92 of the width detector 90 described in reference to FIG. 13, the controller 300 calculates an additional skew amount ΔT, and perform an additional skew correction (deskew operation) by forming a slack, based on the calculated additional skew amount ΔT (steps S26 to S30).

As described above, the skew of a sheet and the sheet undelivered jam are detected using the optical sensor 84*b* of the sheet setting detector 84. Accordingly, the image forming apparatus 100 includes a sheet detector in the bypass sheet conveyance passage R, separately from the sheet setting detector 84. Therefore, when compared with the configuration in which the sheet skew correction and the sheet undelivered jam are detected based on the detection result of the sheet detector, the image forming apparatus 100 achieves a reduction in the number of parts, thereby encouraging a reduction in the cost of the image forming apparatus 100.

Figure 16:
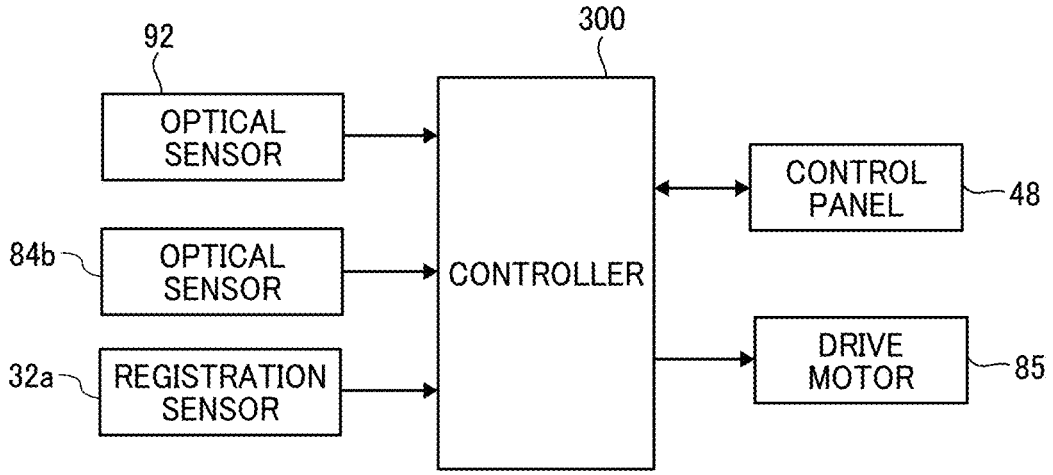
FIG. 16 is a block diagram of a controller in a sheet feeding operation of a bypass sheet feed tray.

FIG. 16 is a block diagram of the controller that controls the bypass sheet feeding operation of the bypass sheet feed tray.

As illustrated in FIG. 16, the controller 300 of the image forming apparatus 100 is connected to the control panel 48, the drive motor 85 that drives the sheet feed roller 61, the optical sensor 92 of the width detector 90, the optical sensor 84*b* of the sheet setting detector 84, and the registration sensor 32*a*.

The controller 300 functions as a discriminator that discriminates whether or not the sheet set on the bypass sheet feed tray 69 is a sheet having the width equal to or greater than the specified width, based on the detection result detecting the detection target portion 91*b* of the width detection feeler 91 and the detection result detecting the sheet in the bypass sheet conveyance passage R, each being detected by the optical sensor 92 of the width detector 90.

The controller 300 also functions as a determiner that determines whether or not the sheet width input by a user matches the sheet width of the sheet set on the bypass sheet feed tray 69, based on the sheet size information input by the user via the control panel 48 and the sheet width information discriminated based on the detection results of the optical sensor 92.

The controller 300 also functions as a skew detector that detects the amount of skew (skew amount) of the sheet, based on the period of time from when the controller 300 causes the drive motor 85 to drive to start feeding the sheet to when the optical sensor 92 of the width detector 90 or the optical sensor 84*b* of the sheet setting detector 84 detects the sheet in the bypass sheet conveyance passage R.

The controller 300 also functions as a skew corrector that corrects the skew of the sheet, in other words, deskews the sheet by controlling the drive motor 85, based on the skew amount obtained when the registration sensor 32*a* detects the sheet.

Further, the present disclosure may be applied to an automatic document feeder (ADF) such as a document conveying device of an image reading device.

Figure 17:
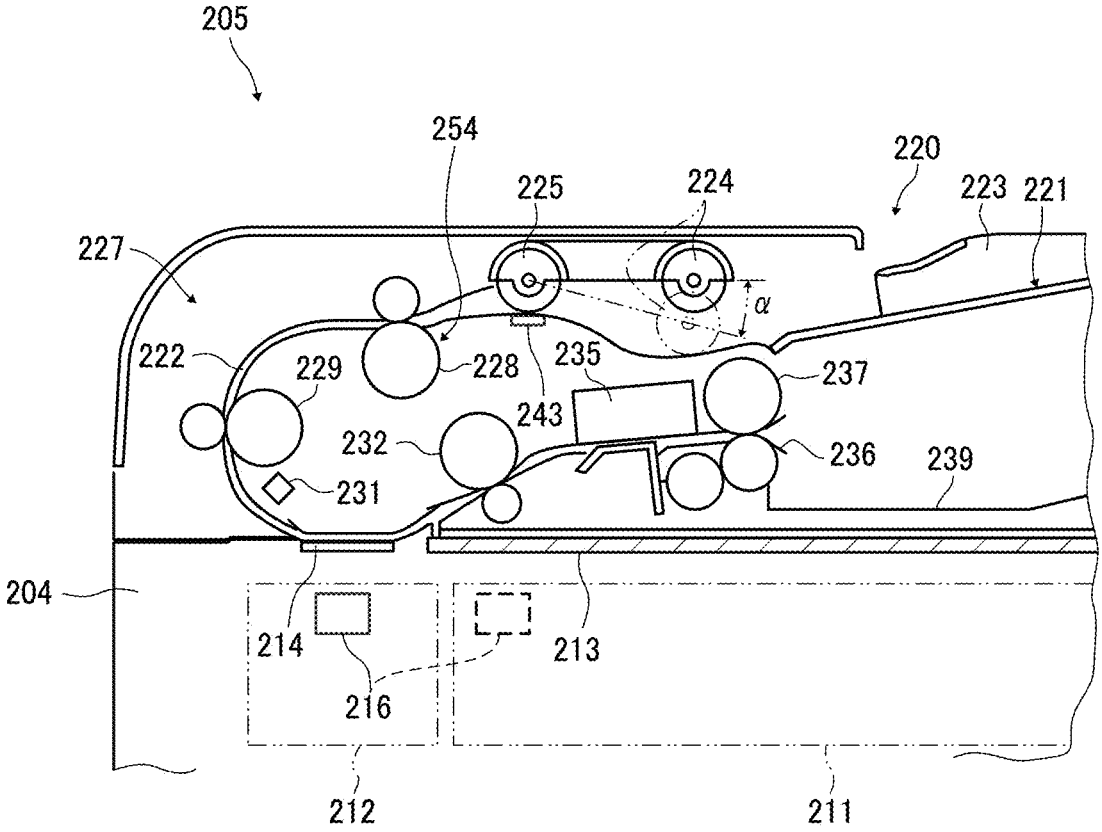
FIG. 17 is an enlarged configuration diagram illustrating an example of an image reading device.

FIG. 17 is an enlarged configuration diagram illustrating an example of an image reading device 205.

The image reading device 205 performs an image reading operation by switching between a flatbed scanner mode (stationary document reading mode) and a DF scanner mode (feeding document reading mode).

The flatbed scanner mode is an operation mode to read an image on an original document placed on a flatbed exposure glass 213. The flatbed scanner mode is executed when a reading start request operation such as pressing of a copy start button is performed in a state in which an original document is placed on the flatbed exposure glass 213 in the upper portion of the scanner 204. Light is emitted to the image forming face of the original document while moving an image reading unit 216 in a moving document reading area 211 immediate below the flatbed exposure glass 213. The image reading unit 216 reads the image on the original document by converting the light reflected on the image forming face of the original document, into an image signal.

The DF scanner mode is an operation mode to read the image on the original document being fed in the image reading device 205 by causing the image reading unit 216 to stop at a stationary document reading area 212 immediate below the DF exposure glass 214.

In the ADF 220 in the DF scanner mode, an original document is separated one by one from a bundle of original documents loaded on a document tray 221 (document loading table) to enter into a document conveyance passage 222, so that the original document is conveyed along the document conveyance passage 222. While being conveyed along the document conveyance passage 222, the original document is brought to the DF exposure glass 214 to face the upper face of the DF exposure glass 214 sequentially and partly from the upstream side of the original document in the document conveyance direction.

The image reading unit 216 may be a reading unit, for example, a charge-coupled device (CCD) module or a contact image sensor (CIS) module, to read an image on the front face of an original document by repeatedly performing line scanning, in other words, scanning the image in line, at a predetermined image reading position on the flatbed exposure glass 213 and the DF exposure glass 214. The image reading device 205 may separately include a fixed reading unit that is fixed to the stationary document reading area 212 and a movable reading unit that is movable in the moving document reading area 211 along the flatbed exposure glass 213.

Side fences 223 are provided on the document tray 221. Each of the side fence 223 is movable in the left and right directions to position the original document set in the ADF 220, in the width direction orthogonal to the document conveyance direction. The side fences 223 are relatively movable to approach each other or separate from each other, so as to match the center of the document tray 221 and the center of the original document in the document width direction. However, the side fences 223 of the document tray 221 are not limited to the above-described structure. For example, one of the side fences 223 of the document tray 221 may be fixed to one lateral side of the document tray 221 in the document width direction so that one lateral end of the original document in the document width direction contacts the one of the side fence 223, and the other of the side fences 223 may be movable.

The ADF 220 further includes a document pickup roller 224, a document feed roller 225, a document separation pad 243. The document pickup roller 224 picks up the original document set on the document tray 221 to feed the original document in the document conveyance direction. The document feed roller 225 and the document separation pad 243 feed the original document picked up in the document conveyance direction by the document pickup roller 224, toward the document conveyance passage 222.

The ADF 220 further includes a document conveying device 227 that conveys the original document fed in the document conveyance passage 222, onto the DF exposure glass 214, in a posture in which the original document is ready to be read. After the image of the original document is read, the document conveying device 227 then conveys the original document to a document ejection port 236.

Further, the document conveying device 227 conveys the original document so that the original document separated and fed by the document feed roller 225 is reversed to return along the document conveyance passage 222 and, at the same time, passes the predetermined reading position on the upper face of the DF exposure glass 214. For such document conveyance, the ADF 220 further includes a first sheet conveying roller 228, a second sheet conveying roller 229, and a registration sensor 231, each being disposed upstream from the DF exposure glass 214 along the document conveyance passage 222 in the document conveyance direction. The registration sensor 231 detects the leading end of the original document in the document conveyance direction.

The original document separated by the document feed roller 225 is conveyed so as to pass over the DF exposure glass 214 by the first sheet conveying roller 228 and the second sheet conveying roller 229. Then, an image on the front face of the original document is timely read by the image reading unit 216, based on the timing of detection of the leading end of the original document by the registration sensor 231.

When the reading of an image on the back face of the original document is requested, the original document is conveyed by a sheet conveying roller 232 that is disposed downstream from the DF exposure glass 214 in the document conveyance direction, and the image on the back face of the original document is read by a back face image reading module 235 (second image reader) including contact-type image sensors for reading an image on the back face of the original document.

After the image on the original document is read, the original document is ejected by a document ejection tray 239 by a document ejection roller 237.

A contact sensor 254 is disposed between the document feed roller 225 and the first sheet conveying roller 228. The contact sensor 254 includes a reflective optical sensor to detect the original document at a predetermined position. After the contact sensor 254 detects the leading end of the original document, the original document is further conveyed, and the leading end of the original document contacts the first sheet conveying roller 228 while the first sheet conveying roller 228 is not rotating. The conveyance roller upstream from the first sheet conveying roller 228 in the document conveyance direction is driven to rotate for a predetermined time from detection of the leading end of the original document by the contact sensor 254. Then, when the predetermined time has elapsed, the conveyance roller stops the rotation. As a result, the original document is bent (warped) by a predetermined amount, and the skew of the original document is corrected, in other words, the original document is deskewed.

The above-described ADF 220 includes the sheet setting detector 84 having the same configuration illustrated in FIGS. 14A to 14C. The ADF 220 uses the contact sensor 254 that functions as an optical sensor to detect the set feeler 84*a* of the sheet setting detector 84. When no original document is set on the document tray 221, the set feeler 84*a* is at the first position at which the detection target portion 184*b* is located in the detection area of the contact sensor 254, which is similar to the configuration illustrated in FIGS. 14A to 14C. When the original document is set on the document tray 221 and the set feeler 84*a* rotates, the set feeler 84*a* is at the second position at which the detection target portion 184*b* retracts from the contact sensor 254. Accordingly, the setting of the original document is detected using the contact sensor 254. After the original document is set, the contact sensor 254 may detect the original document in the document conveyance passage 222.

The configurations described above are examples, and aspects of the present disclosure provide respective effects as follows.

Aspect 1

The sheet conveying device (for example, the bypass sheet feeding device 200) includes a sheet loader (for example, the bypass sheet feed tray 69), a sheet feeder (for example, the sheet feed roller 61), an optical sensor (for example, the optical sensor 92), and a rotary member (for example, the width detection feeler 91). The sheet loader is configured to load a sheet (for example, the sheet P). The sheet feeder is configured to feed the sheet loaded on the sheet loader. The optical sensor is configured to detect the sheet at a predetermined position on the sheet loader in a width direction of the sheet and at a predetermined position in a sheet conveyance passage (for example, the bypass sheet conveyance passage R) in the width direction of the sheet. The rotary member is configured to detect the sheet at the predetermined position in the sheet conveyance passage. The rotary member is configured to configured to rotate to a first position when the sheet is not at the predetermined position on the sheet loader in the width direction of the sheet and a second position when the sheet is at the predetermined position on the sheet loader. The rotary member has a detection target portion (for example, the detection target portion 91*b*) to be detected by the optical sensor when the rotary member is located at the first position or the second position.

According to this configuration, the presence or absence of a sheet at the predetermined position in the sheet width direction of the sheet in the sheet loader and the presence or absence of the sheet at the predetermined position in the sheet width direction of the sheet in the sheet conveyance passage are detected with a single optical sensor and a single rotary member. Accordingly, when compared with a known sheet conveying device that has the configuration including a first detector that detects the presence or absence of a sheet in the sheet width direction of the sheet in the sheet loader and a second detector that detects the presence or absence of the sheet at the predetermined position in the sheet width direction of the sheet in the sheet conveyance passage, and each of the first detector and the second detector is provided with an optical sensor and a rotary member, the sheet conveying device of Aspect 1 reduces the number of parts and components, and therefore the cost of the sheet conveying device is reduced.

Aspect 2

In Aspect 1, in the sheet conveying device of Aspect 1, the sheet includes a large-size sheet having a width equal to or greater than a specified width, the rotary member (for example, the width detection feeler 91) is configured to be located at the second position when the large-size sheet is set on the sheet loader (for example, the bypass sheet feed tray 69), the optical sensor (for example, the optical sensor 92) is disposed at a position to detect the large-size sheet in the sheet conveyance passage, and the optical sensor is configured to detect the detection target portion (for example, the detection target portion 91*b*) when the rotary member is located at the second position.

According to this configuration, as described in the embodiments above, when the sheet having the width equal to or greater than the predetermined width is loaded on the sheet loader (the bypass sheet feed tray 69) without the skew of the sheet, the optical sensor (the optical sensor 92) detects the detection target portion (for example, the detection target portion 91*b*). According to this movement of the detection target portion, the optical sensor detects that the sheet having the width equal to or greater than the predetermined width is set on the sheet loader. In addition, when the optical sensor (the optical sensor 92) did not detect the detection target portion (the detection target portion 91*b*), the sheet is fed. Then, when the optical sensor detected the sheet, the sheet conveying device of Aspect 2 determines that the sheet having the width equal to or greater than the predetermined width is set in the skew state.

Aspect 3

In Aspect 2, the sheet conveying device of Aspect 2 further includes an input device (for example, the control panel 48) and circuitry (for example, the controller 300). The input device is a device through which a width size of the sheet to be set on the sheet loader (the bypass sheet feed tray 69) is input. The circuitry is configured to determine whether the width size of the sheet set on the sheet loader matches the sheet width input via the input device, based on information on whether the optical sensor (the optical sensor 92) detects the detection target portion (for example, the detection target portion 91*b*) and a detection result of the sheet by the optical sensor.

Even though the sheet having the width equal to or greater than the specified width is originally supposed to be detected by which the rotary member (for example, the width detection feeler 91) rotates from the second position to the first position so that the optical sensor (the optical sensor 92) detects the detection target portion (the detection target portion 91*b*), the rotary member may not rotate due to the sheet setting in the skewed state.

According to this configuration, as described in the embodiment described above, even if the rotary member does not rotate due to the skewed state in the sheet setting of the sheet having the width equal to or greater than the specified width, the optical sensor detects the sheet while the sheet is being conveyed, the circuitry (the controller 300) determines that the sheet loaded on the sheet loader (the bypass sheet feed tray 69) is the sheet having the width equal to or greater than the specified width.

Accordingly, when compared with a known sheet conveying device that has the configuration to determine whether or not the width of the sheet set on the sheet loader matches the width of the sheet input by a user via the input device based on the information whether or not the optical sensor detects the detection target portion, the sheet conveying device of Aspect 3 detects the sheet more accurately.

Aspect 4

In Aspect 3, the circuitry (for example, the controller 300 as a determiner) is configured to determine that the large-size sheet is set on the sheet loader (for example, the bypass sheet feed tray 69) when the optical sensor (for example, the optical sensor 92) detects the detection target portion (for example, the detection target portion 91*b*) or the sheet in the sheet conveyance passage (for example, the bypass sheet conveyance passage R).

According to this configuration of Aspect 4, as described in the above-described embodiments, the circuitry (the controller 300) correctly determines whether the sheet set on the sheet loader (the bypass sheet feed tray 69) is the sheet having the width equal to or greater than the predetermined width.

Aspect 5

In Aspect 3 or Aspect 4, the circuitry (for example, the controller 300 as a determiner) is configured to determine that the sheet width input via the input device (for example, the control panel 48) is different from the width of the sheet set on the sheet loader (for example, the bypass sheet feed tray 69), and notify a determination result that the sheet width input via the input device is different from the width of the sheet set on the sheet loader.

According to this configuration, as described in the embodiments above, the sheet conveying device of Aspect 5 encourages the user to change the sheet to be set on the sheet loader (the bypass sheet feed tray 69) and change the information of the width of the sheet to be input in the input device.

Aspect 6

In Aspect 1, the sheet conveying device further includes circuitry (the controller 300) configured to determine whether the sheet is set on the sheet loader (for example, the bypass sheet feed tray 69). The optical sensor (for example, the optical sensor 84*b*) is configured to detect the detection target portion (for example, the detection target portion 184*b*) when the detection target portion is at the first position, and the circuitry (for example, the controller 300)

is configured to determine that the sheet is set on the sheet loader when the optical sensor changes from a detection state in which the optical sensor detects the detection target portion to a non-detection state in which the optical sensor does not detect the detection target portion.

The optical sensor (the optical sensor 84*b*) detects the sheet setting according to the change of the detection state of the detection target portion (the detection target portion 184*b*). Further, when the circuitry (the controller 300) determines that the sheet is set on the sheet loader (the bypass sheet feed tray 69), the detection target portion (the detection target portion 184*b*) is retracted from the optical sensor (the optical sensor 84*b*), so that the presence or absence of the sheet in the sheet conveyance passage (for example, the bypass sheet conveyance passage R) is detected by the optical sensor. Accordingly, the sheet conveying device of Aspect 6 determines an undelivered jam and detects the skew state of the sheet set on the sheet loader, based on the sheet detection result of the optical sensor (the optical sensor 84*b*).

Aspect 7

In Aspect 6, in a case in which the optical sensor (for example, the optical sensor 84*b*) does not detect the sheet when a predetermined time has elapsed from when the sheet feeder (for example, the sheet feed roller 61) starts feeding the sheet loaded on the sheet loader (for example, the bypass sheet feed tray 69), the circuitry (for example, the controller 300) is configured to determine that a sheet jam occurs.

According to this configuration of Aspect 7, a single optical sensor detects the sheet setting and a sheet jam.

Aspect 8

In any one of Aspects 3 to 7, the circuitry (the controller 300 as a skew detector and a skew corrector) is configured to detect a sheet skew of the sheet based on a timing at which the optical sensor detects the sheet, correct the sheet skew, and adjust a skew correction amount based on a detection result of the sheet skew.

According to this configuration of Aspect 8, the sheet skew is deskewed reliably.

Aspect 9

In Aspect 8, the circuitry (for example, the controller 300 functioning as a skew detector) is configured to detect an amount of the sheet skew according to a difference value between a specified time (for example, the theoretical arrival time T0) previously determined and a time from a specified timing to a detection of the sheet by the optical sensor.

According to this configuration of Aspect 9, the skew amount of the sheet is obtained.

Aspect 10

In Aspect 9, the circuitry (for example, the controller 300) is configured to execute a specified time correction mode (for example, the theoretical arrival time correction mode) to correct the specified time.

According to this configuration of Aspect 10, as described in the embodiments above, the specified time (for example, the theoretical arrive time T0) is obtained considering the impacts caused by the variation in the characteristics of each device due to the variation in parts and components and the change of the characteristics due to use with time, and deterioration in the calculation accuracy of the skew amount is restrained.

Aspect 11

In Aspect 8, the sheet conveying device further includes another optical sensor (the optical sensor 92A) opposite to the optical sensor (for example, the optical sensor 92) across a center in a width direction of the sheet conveyance passage (for example, the bypass sheet conveyance passage R). The circuitry (for example, the controller 300 as a skew detector) is configured to detect the sheet skew from when one of the optical sensor and said another optical sensor detects the sheet to when the other of the optical sensor and said another optical sensor detects the sheet.

According to this configuration of Aspect 11, the skew amount is calculated without being affected by the variation of the position of the leading end of the sheet on the sheet loader (for example, the bypass sheet feed tray 69), and the calculation accuracy of the skew amount is enhanced. Further, the direction of the skew of the sheet is detected depending on which of the optical sensor and said another optical sensor detects the sheet first.

Aspect 12

An image reading device (for example, the image reading device 205) includes the sheet conveying device (for example, the ADF 220) of any one of Aspects 1 to 11, being configured to convey the sheet (for example, the original document), and an image reading device (for example, the scanner 204) configured to read an image on the sheet conveyed by the sheet conveying device.

According to this configuration, the number of components is reduced, and therefore a reduction in cost of the sheet conveying device is achieved.

Aspect 13

An image forming apparatus (for example, the image forming apparatus 100) of Aspect 13 includes the sheet conveying device (for example, the bypass sheet feeding device 200) of any one of Aspects 1 to 11, being configured to convey the sheet, and an image forming device (for example, the process units 1C, 1M, 1Y, and 1K) configured to form an image on the sheet conveyed by the sheet conveying device.

According to this configuration, the number of components is reduced, and therefore a reduction in cost of the sheet conveying device is achieved.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a sheet loader configured to load a sheet;

a sheet feeder configured to feed the sheet loaded on the sheet loader, a rotary member including a detection target portion, the rotary member configured to rotate to a first position when the sheet is not at a first location on the sheet loader in a width direction of the sheet, and rotate to a second position when the sheet is at the first location on the sheet loader; and an optical sensor configured to emit light toward a sheet conveyance passage located downstream from the sheet loader in a sheet conveyance direction, receive the emitted light reflected from the sheet at the sheet conveyance passage, detect the sheet at the sheet conveyance passage, and detect the detection target portion of the rotary member in the first position.

2. The sheet conveying device according to claim 1, wherein the rotary member is configured to be in the second position in response to a large-size sheet being set on the sheet loader, the large-size sheet having a width equal to or greater than a specified width, wherein the optical sensor is disposed at a position such that the optical sensor is configured to detect the large-size sheet in the sheet conveyance passage, and wherein the optical sensor is configured to detect the detection target portion when the rotary member is in the second position.

3. The sheet conveying device according to claim 2, further comprising:

an input device configured to receive an input indicating a width of the sheet to be set on the sheet loader; and circuitry configured to determine whether the width of the sheet set on the sheet loader matches the width of the sheet indicated by the input, based on a detection result of the detection target portion by the optical sensor and a detection result of the sheet by the optical sensor.

4. The sheet conveying device according to claim 3, wherein the circuitry is configured to determine that the large-size sheet is set on the sheet loader in response to the optical sensor detecting the detection target portion or the optical sensor detecting the sheet in the sheet conveyance passage.

5. The sheet conveying device according to claim 3, wherein the circuitry is configured to:

determine that the width of the sheet input via the input device is different from the width of the sheet set on the sheet loader; and notify a determination result that the width of the sheet input via the input device is different from the width of the sheet set on the sheet loader.

6. The sheet conveying device according to claim 3, wherein the circuitry is configured to:

detect a sheet skew of the sheet based on a timing at which the optical sensor detects the sheet;

correct the sheet skew; and adjust a skew correction amount based on a detection result of the sheet skew.

7. The sheet conveying device according to claim 6, wherein the circuitry is configured to detect an amount of the sheet skew according to a difference value between a specified time and a time from a specified timing to a detection of the sheet by the optical sensor.

8. The sheet conveying device according to claim 7, wherein the circuitry is configured to execute a specified time correction mode to correct the specified time.

9. The sheet conveying device according to claim 6, further comprising a second optical sensor opposite to the optical sensor across a center in a width direction of the sheet conveyance passage, wherein the circuitry is configured to detect the sheet skew from when one of the optical sensor and the second optical sensor detects the sheet to when the other of the optical sensor and the second optical sensor detects the sheet.

10. The sheet conveying device according to claim 2, further comprising circuitry configured to control a space between sheets to be a first distance in response to determining the sheet is the large-size sheet and a second distance greater than the first distance in response to determining that the sheet is a small sized sheet.

11. The sheet conveying device according to claim 1, further comprising circuitry configured to determine whether the sheet is set on the sheet loader, wherein the optical sensor is configured to detect the detection target portion of the rotary member at the first position, and wherein the circuitry is configured to determine that the sheet is set on the sheet loader in response to the optical sensor changing from a detection state in which the optical sensor detects the detection target portion to a non-detection state in which the optical sensor does not detect the detection target portion.

12. The sheet conveying device according to claim 11, wherein the circuitry is configured to determine a sheet jam in response to the optical sensor not detecting the sheet at a given time from when the sheet feeder starts feeding the sheet loaded on the sheet loader.

13. An image reading device comprising:

the sheet conveying device according to claim 1, the sheet conveying device being configured to convey the sheet; and an image reading device configured to read an image on the sheet conveyed by the sheet conveying device.

14. The sheet conveying device according to claim 1, wherein the rotary member further comprises a sheet contact face configured to contact a distal end of the sheet, in the sheet conveyance direction, on the sheet loader, wherein the detection target portion is at a distal end of the sheet contact face, and wherein the detection target portion includes a cutout configured to allow light emitted from the optical sensor to pass through the detection target portion.

15. The sheet conveying device according to claim 14 wherein the optical sensor is configured to detect the detection target portion of the rotary member in the second position and to detect a presence or absence of the sheet through the cutout of the rotary member in the second position.

16. The sheet conveying device according to claim 15, further comprising circuitry configured to determine that the sheet is a large-size sheet in a skewed state in response to the optical sensor detecting a presence of the sheet through the cutout.

17. The sheet conveying device according to claim 16 wherein the circuitry is configured to determine that the sheet is a small-size sheet in response to the optical sensor not detecting the detection target portion of the rotary member or the sheet through the cutout.

18. The sheet conveying device according to claim 1, wherein the optical sensor is a reflection-type optical sensor.

19. An image forming apparatus comprising:

the sheet conveying device according to claim 1, the sheet conveying device being configured to convey the sheet; and an image forming device configured to form an image on the sheet conveyed by the sheet conveying device.

* * * * *